US010982904B2

(12) United States Patent
Bugler et al.

(10) Patent No.: US 10,982,904 B2
(45) Date of Patent: Apr. 20, 2021

(54) ADVANCED LARGE SCALE FIELD-ERECTED AIR COOLED INDUSTRIAL STEAM CONDENSER

(71) Applicant: Evapco, Inc., Taneytown, MD (US)

(72) Inventors: Thomas W. Bugler, Frederick, MD (US); Jean-Pierre Libert, Frederick, MD (US); Mark Huber, Sykesville, MD (US); Toby Athron, Belle Mead, NJ (US); Wayne Sexton, Taneytown, MD (US); Ben Hildebrandt, Denver, CO (US)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 16/815,862

(22) Filed: Mar. 11, 2020

(65) Prior Publication Data

US 2020/0333078 A1 Oct. 22, 2020

Related U.S. Application Data

(63) Continuation-in-part of application No. 16/562,778, filed on Sep. 6, 2019.
(Continued)

(51) Int. Cl.
*F28B 7/00* (2006.01)
*F28B 9/02* (2006.01)
*F28B 1/06* (2006.01)

(52) U.S. Cl.
CPC ..... *F28B 7/00* (2013.01); *F28B 1/06* (2013.01); *F28B 9/02* (2013.01)

(58) Field of Classification Search
CPC ..... F28B 1/06; F28B 7/00; F28B 9/02; F28B 9/10; F28B 9/12; F28B 2001/065; F28F 27/02; F28F 9/013
See application file for complete search history.

(56) References Cited

U.S. PATENT DOCUMENTS 3,707,185 A 12/1972 Mdoine et al.
3,814,177 A 6/1974 Harris et al.
(Continued)

FOREIGN PATENT DOCUMENTS

DE 1945314 3/1971

OTHER PUBLICATIONS

International Search Report issued in co-pending application No. PCT/US20/22259 dated June 15, 2020.

*Primary Examiner* — Elizabeth J Martin
(74) *Attorney, Agent, or Firm* — Whiteford, Taylor & Preston, LLP; Peter J. Davis

(57) ABSTRACT

A large scale field erected air cooled industrial steam condenser having heat exchanger panels independently loaded into and supported in a heat exchange frame section. A bottom bonnet runs along the bottom length of each heat exchanger panel for delivering steam to the bottom end of condenser tubes in the heat exchange panel and for receiving condensate formed in those same tubes. The tops of the tubes are connected to a top bonnet. Uncondensed steam and non-condensables are drawn into the top bonnet from the condenser tubes. A steam distribution manifold is suspended from the heat exchange section frame perpendicular to the longitudinal axis of the heat exchange panels and beneath a center point of the heat exchange panels and delivers steam to each heat exchange panel via a single steam inlet located at a center point of each bottom bonnet.

23 Claims, 31 Drawing Sheets

Related U.S. Application Data

(60) Provisional application No. 62/730,764, filed on Sep. 13, 2018, provisional application No. 62/728,269, filed on Sep. 7, 2018, provisional application No. 62/900,195, filed on Sep. 13, 2019, provisional application No. 62/902,521, filed on Sep. 19, 2019, provisional application No. 62/928,116, filed on Oct. 30, 2019, provisional application No. 62/946,039, filed on Dec. 10, 2019.

(56) References Cited

U.S. PATENT DOCUMENTS

| | | | | |
|---|---|---|---|---|
| 2005/0161094 | A1 | 7/2005 | Schmidt | |
| 2010/0006270 | A1 | 1/2010 | Vouche | |
| 2013/0312932 | A1 | 11/2013 | Vouche et al. | |
| 2015/0204611 | A1 | 7/2015 | Vouche et al. | |
| 2015/0330709 | A1 | 11/2015 | Vouche et al. | |
| 2015/0345166 | A1 | 12/2015 | Quickelberghe et al. | |
| 2017/0363357 | A1 | 12/2017 | Bugler et al. | |
| 2017/0363358 | A1* | 12/2017 | Bugler, III | F28F 9/02 |
| 2018/0023901 | A1 | 1/2018 | Bugler et al. | |
| 2019/0093953 | A1* | 3/2019 | Singh | F28D 1/05308 |
| 2019/0242660 | A1 | 8/2019 | Badin et al. | |

* cited by examiner

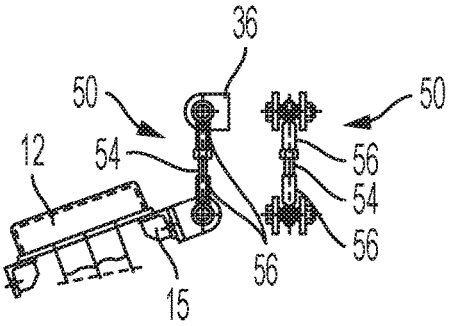

BUNDLE IN COLD POSITION

HANGER ROD CONFIGURATION OPTION-1
SCALE: 2n = 1' – 0"

FIG. 18A

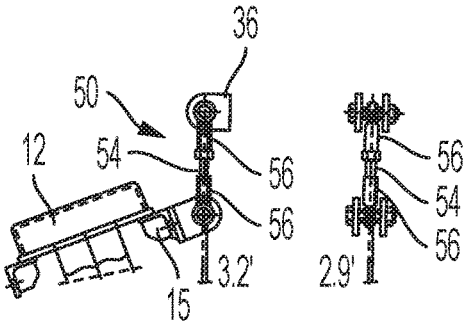

BUNDLE VERTICAL EXPANSION HAMMER DUCT HORIZONTAL EXPANSION

BUNDLE HORIZONTAL EXPANSION

BUNDLE IN HOT POSITION

HANGER ROD CONFIGURATION OPTION-1
SCALE: 2n = 1' – 0"

FIG. 18B

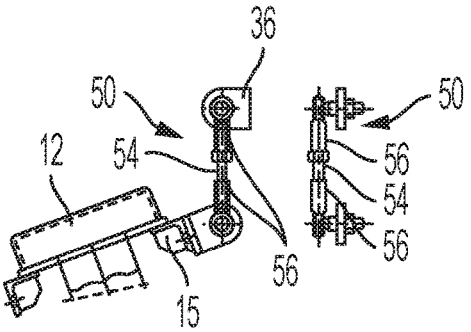

BUNDLE IN COLD POSITION

HANGER ROD CONFIGURATION OPTION-2
SCALE: 2n = 1' – 0"

FIG. 19A

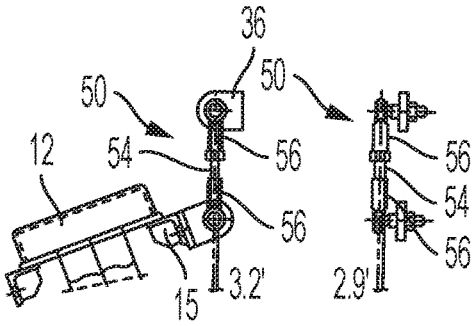

BUNDLE VERTICAL EXPANSION HAMMER DUCT HORIZONTAL EXPANSION

BUNDLE HORIZONTAL EXPANSION

BUNDLE IN HOT POSITION

HANGER ROD CONFIGURATION OPTION-2
SCALE: 2n = 1' – 0"

FIG. 19B

ELEVATION VIEW

ELEVATION VIEW B-B
CONDENSATE/DEAERATOR TANK
PUMP PIT AND STAIR TOWER OMMITED FOR CLARITY

ADVANCED LARGE SCALE FIELD-ERECTED AIR COOLED INDUSTRIAL STEAM CONDENSER

CROSS REFERENCE TO RELATED APPLICATION

This application is a continuation in part of U.S. patent application Ser. No. 16/562,778 entitled "ADVANCED LARGE SCALE FIELD-ERECTED AIR COOLED INDUSTRIAL STEAM CONDENSER," filed with the U.S. Patent and Trademark Office on Sep. 6, 2019, which is based upon co-owned U.S. Provisional Patent Application Ser. No. 62/730,764 entitled "ADVANCED LARGE SCALE FIELD-ERECTED AIR COOLED INDUSTRIAL STEAM CONDENSER," filed with the U.S. Patent and Trademark Office on Sep. 13, 2018, and U.S. Provisional Patent Application Ser. No. 62/728,269 entitled "ADVANCED LARGE SCALE FIELD-ERECTED AIR COOLED INDUSTRIAL STEAM CONDENSER," filed with the U.S. Patent and Trademark Office on Sep. 7, 2018, the specification of which is incorporated herein by reference. This application also claims priority to U.S. Provisional Patent Application Ser. No. 62/900,195 entitled "ADVANCED LARGE SCALE FIELD-ERECTED AIR COOLED INDUSTRIAL STEAM CONDENSER," filed with the U.S. Patent and Trademark Office on Sep. 13, 2019, U.S. Provisional Patent Application Ser. No. 62/902,521 entitled "ADVANCED LARGE SCALE FIELD-ERECTED AIR COOLED INDUSTRIAL STEAM CONDENSER WITH ELEVATED STEAM DISTRIBUTION MANIFOLD," filed with the U.S. Patent and Trademark Office on Sep. 19, 2019, U.S. Provisional Patent Application Ser. No. 62/928,116 entitled "ADVANCED LARGE SCALE FIELD-ERECTED AIR COOLED INDUSTRIAL STEAM CONDENSER WITH ALTERNATIVE HEAT EXCHANGE PANEL CONFIGURATIONS," filed with the U.S. Patent and Trademark Office on Oct. 30, 2019, and U.S. Provisional Patent Application Ser. No. 62/946,039 entitled "ADVANCED LARGE SCALE FIELD-ERECTED AIR COOLED INDUSTRIAL STEAM CONDENSER WITH ALTERNATIVE FAN DECK CONFIGURATION," filed with the U.S. Patent and Trademark Office on Dec. 10, 2019, the specification of which is incorporated herein by reference.

BACKGROUND OF THE INVENTION

Field of the Invention

The present invention relates to large scale field erected air cooled industrial steam condensers.

Description of the Background

The typical large scale field erected air cooled industrial steam condenser is constructed of heat exchange bundles arranged in an A-frame arrangement above a large fan, with one A-frame per fan. Each tube bundle typically contains 35-45 vertically oriented flattened finned tubes, each tube approximately 11 meters in length by 200 mm in height, with semi-circular leading and trailing edges, and 18-22 mm external width. Each A-frame typically contains five to seven tube bundles per side.

The typical A-Frame ACC described above also includes both $1^{st}$ stage or "primary" condenser bundles (sometimes referred to as K-bundles for Kondensor) and $2^{nd}$ stage or "secondary" condenser bundles (sometimes referred to as D-bundles for Dephlegmator). About 80% to 90% of the heat exchanger bundles are $1^{st}$ stage or primary condenser. The steam enters the top of the primary condenser bundles and the condensate and some steam leave the bottom. In the $1^{st}$ stage the steam and condensate travel down the heat exchanger bundles and this process is commonly referred to as the co-current condensing stage. The first stage configuration is thermally efficient; however, it does not provide a means for removing non-condensable gases. To sweep the non-condensable gases through the $1^{st}$ stage bundles, 10% to 20% of the heat exchanger bundles are configured as $2^{nd}$ stage or secondary condensers, typically interspersed among the primary condensers, which draw vapor from the lower condensate manifold. In this arrangement, steam and non-condensable gases travel through the $1^{st}$ stage condensers as they are drawn into the bottom of the secondary condenser. As the mixture of gases travels up through the secondary condenser, the remainder of the steam condenses, concentrating the non-condensable gases at the top while the condensate drains to the bottom. This process is commonly referred to as the counter-current condensing stage. The tops of the secondary condensers are attached to a vacuum manifold which removes the non-condensable gases from the system.

Variations to the standard prior art ACC arrangement have been disclosed, for example in US 2015/0204611 and US 2015/0330709. These applications show the same finned tubes, but drastically shortened and then arranged in a series of small A-frames, typically five to six A-frames per fan. Part of the logic is to reduce the steam-side pressure drop, which has a small effect on overall capacity at summer condition, but greater effect at a winter condition. Another part of the logic is to weld the top steam manifold duct to each of the bundles at the factory and ship them together, thus saving expensive field welding labor. The net effect of this arrangement, with the steam manifold attached at the factory and shipped with the tube bundles, is a reduction of the tube length to accommodate the manifold in a shipping container.

Additional variations to the prior art ACC arrangements are disclosed, for example in US 2017/0363357 and US 2017/0363358. These applications disclose a new tube construction for use in ACCs having a cross-sectional height of 10 mm or less. US 2017/0363357 also discloses a new ACC arrangement having heat exchanger bundles in which the primary condenser bundles are arranged horizontally along the longitudinal axis of the bundles and the secondary bundles are arranged parallel to the transverse axis. US 2017/0363358 discloses an ACC arrangement in which all of the tube bundles are secondary bundles.

SUMMARY OF THE INVENTION

The invention presented herein is a new and improved design for large scale field-erected air cooled industrial steam condensers for power plants and the like which provides significant improvements and advantages over the ACCs of the prior art.

According to one embodiment of the present invention, heat exchanger panels are constructed with an integral secondary condenser section positioned in the center of the heat exchanger panel, flanked by primary condenser sections which may or may not be identical to one-another. A bottom bonnet runs along the bottom length of the heat exchanger panel, connected to the bottom side of the bottom tube sheet, for delivering steam to the bottom end of the primary condenser tubes. In this arrangement, the $1^{st}$ stage of condensing occurs in counter-current operation. The tops of the tubes are connected to a top tube sheet, which in turn is connected on its top side to a top bonnet. Uncondensed steam and non-condensables flow into the top bonnet from the primary condenser tubes and flow toward the center of the heat exchanger panel where they enter the top of the secondary condenser section tubes. In this arrangement the $2^{nd}$ stage of condensing occurs in co-current operation. Non-condensables and condensate flow out the bottom of the secondary tubes into an internal secondary chamber located inside the bottom bonnet. Non-condensables and condensate are drawn from the bottom bonnet secondary chamber via outlet nozzle, and condensate is drawn off and sent to join the water collected from the primary condenser sections.

According to an alternate embodiment, the heat exchanger panels may be constructed as single stage condenser heat exchange panels, in which all the tubes of the heat exchanger panels receive steam from and deliver condensate to the bottom bonnet, and non-condensables are drawn off via the top bonnet. More specifically, a bottom bonnet runs along the bottom length of the heat exchanger panel as with the multiple stage embodiment, connected to the bottom side of the bottom tube sheet, but in the single stage embodiment, the bottom bonnet delivers steam to the bottom end of all the tubes in the heat exchanger panel. As with the multiple stage embodiment, the tops of all of the tubes are connected to a top tube sheet, which in turn is connected on its top side to a top bonnet. Uncondensed steam and non-condensables flow into the top bonnet from all of the tubes in the heat exchanger panel and are drawn away from the top bonnet for further processing. Condensate flows out the bottom of all of the tubes into the bottom bonnet, and into the steam distribution manifold.

According to various embodiments of the invention, each heat exchanger panel may be independently loaded into and supported in the heat exchange section framework. According to one embodiment, adjacent panels may be inclined relative to vertical in opposite directions in an arrangement resembling an A-frame or V-frame type of arrangement, although there is preferably no relation or interaction between adjacent panels. According to another embodiment, each heat exchange panel may be oriented vertically, with an optional air deflection or seal positioned at an angle between each adjacent panel. According to a further embodiment, all of the heat exchange panels may be inclined at an angle relative to vertical, all in the same direction. According to yet another embodiment, all of the heat exchange panels on one side of a heat exchange section may be inclined relative to vertical in one direction, and all of the heat exchange panels on the other side of the heat exchange section may be inclined relative to vertical in an opposite direction.

According to some embodiments of the invention, each cell or module of the ACC has a plenum section module with a single fan large fan creating an air flow over all of the heat exchange panels in the same module.

According to other embodiments of the invention, the plenum section module may include a plurality of longitudinal fan deck plates arranged over the fan deck framework, each fan deck plate having a plurality of fans. According to various aspects of this embodiment, the fan deck plates may be aligned so that their longitudinal axis is parallel to or perpendicular to the longitudinal axes of the heat exchange panels in the same ACC module.

According to a further embodiment of the invention, a lower steam distribution manifold runs under a plurality of ACC cells/modules in a row, and the heat exchange panels of each cell or module of the ACC is fed by a single riser which delivers its steam to a dedicated upper steam distribution manifold, preferably comprising a large horizontal cylinder closed at both ends, suspended from below the heat exchange section support framework, perpendicular to the longitudinal axis of the heat exchanger panels, and beneath the center point of each heat exchanger panel. The upper steam distribution manifold feeds steam to the bottom bonnet of each heat exchanger panel at a single location at the center point of the each panel.

According to a further embodiment of the invention, the heat exchange module frame and the heat exchanger panels for each cell are pre-assembled at ground level. The heat exchange module frame is then supported on an assembly fixture just high enough to suspend the upper steam distribution manifold from the underside of the heat exchange module frame. Separately, the plenum section, which includes the fan deck and fan set for a corresponding heat exchange module, is likewise assembled at ground level. Sequentially or simultaneously, the understructure for the corresponding heat exchange module may be assembled in its final location. The heat exchange module, with the upper steam distribution manifold suspended therefrom, may then be lifted in its entirety and placed on top of the understructure, followed by similar lifting and placement of the completed plenum section sub-assembly.

According to an alternate embodiment of the invention, the plurality of upper steam distribution manifolds for a plurality of cells are combined into a single elevated steam manifold that is suspended from and runs the length of a plurality of condenser modules. According to this embodiment, the lower steam manifold and riser is eliminated, and the elevated steam manifold is fed directly from the turbine exhaust duct which itself is elevated to the level of the elevated steam manifold. The elevated steam manifold feeds steam to the bottom bonnet of each heat exchanger panel at a single location at the center point of the panel.

This new ACC design may be used with tubes having prior art cross-section configuration and area (for example, 200 mm×18-22 mm). Alternatively, this new ACC design may be used with tubes having the design described in US 2017/0363357 and US 2017/0363358 (200 mm×10 mm or less), the disclosures of which are hereby incorporated herein in their entirety.

According to a further alternative embodiment, the new ACC design of the present invention may be used with 100 mm by 5 mm to 7 mm tubes having offset fins.

According to a further embodiment, the new ACC design of the present invention may be used with 200 mm by 5 mm to 7 mm tubes or 200 mm by 17-20 mm tubes, the tubes preferably having "Arrowhead"-type fins arranged at 5-12 fins per inch (fpi), preferably at 9-12 fpi, and most preferably at 9.8 fins per inch.

According to a further embodiment, the new ACC design of the present invention may be used with 120 mm by 5 mm to 7 mm tubes having "Arrowhead"-type fins arranged at 9.8 fins per inch. According to an even further embodiment, the new ACC design of the present invention may be used with 140 mm by 5 mm to 7 mm tubes having "Arrowhead"-type fins arranged at 9.8 fins per inch. While the 120 mm and 140 mm configurations do not produce quite the same increase in capacity as the 200 mm configuration, both the 120 mm and 140 mm configurations have reduced materials and weight compared to the 200 mm design.

For a disclosure of the structure of Arrowhead-type fins discussed above, the disclosure of U.S. application Ser. No. 15/425,454, filed Feb. 6, 2017 is incorporated herein in its entirety.

According to yet another embodiment, the new ACC design of the present invention may be used with tubes having "louvered" fins, which perform approximately as well as offset fins, and are more readily available and easier to manufacture.

The description of fin type and dimension herein is not intended to limit the invention. The tubes of the invention described herein may be used with fins of any type without departing from the scope of the invention.

Accordingly, there is provided according to the invention, a large scale field erected air cooled industrial steam condenser connected to an industrial steam producing facility, having a single or plurality of condenser streets, each condenser street comprising a row of condenser modules, each condenser module comprising a plenum section having a single fan or multiple fans drawing air through a plurality of heat exchanger panels supported in a heat exchanger section, and each heat exchanger panel having a longitudinal axis and a transverse axis perpendicular to its longitudinal axis, each heat exchanger panel having a plurality of tubes, a top bonnet connected to and in fluid communication with a top end of each tube, a bottom bonnet connected to and in fluid communication with a bottom end of at least a subset of said tubes, said bottom bonnet having a single steam inlet; each condenser street including a steam distribution manifold suspended from the heat exchanger section and arranged along an axis that is perpendicular to a longitudinal axis of said heat exchanger panels at a midpoint of said heat exchanger panels and extending a length of said condenser street beneath a plurality of heat exchanger panels, said steam distribution manifold including a cylinder having first and second ends, the cylinder closed at a second end distal from the first end, the cylinder having at its top surface a plurality of connections, each connection adapted to connect to a corresponding single steam inlet.

There is further provided according to an embodiment of the invention, a large scale field erected air cooled industrial steam condenser wherein each heat exchanger panel comprises a single condenser stage in which all tubes in the heat exchanger panel receive steam from a bottom end of said tubes.

There is further provided according to an embodiment of the invention, a large scale field erected air cooled industrial steam condenser, in which the top bonnet is configured to receive non-condensable gasses, and optionally uncondensed steam, from said condenser tubes, and does not provide steam to said tubes.

There is further provided according to an embodiment of the invention, a large scale field erected air cooled industrial steam condenser, wherein each heat exchanger panel comprises a secondary condenser section, a primary condenser section and a top bonnet connected to and in fluid communication with a top end of each tube in said secondary condenser section and said primary condenser sections, a primary bottom bonnet connected to and in fluid communication with a bottom end of each tube in said primary condenser sections, an internal secondary chamber inside the bottom bonnet connected to and in fluid communication with a bottom end of each tube in said secondary condenser section, said secondary bottom bonnet connected to a top side of said primary bottom bonnet, each said primary bottom bonnet having a single stem inlet.

There is further provided according to an embodiment of the invention, a large scale field erected air cooled industrial steam condenser wherein each heat exchanger panel comprises two primary condenser sections flanking said secondary section.

There is further provided according to an embodiment of the invention, a large scale field erected air cooled industrial steam condenser, wherein the secondary condenser section is centrally located along said heat exchange panel and flanked at each end by primary condenser sections.

There is further provided according to an embodiment of the invention, a large scale field erected air cooled industrial steam condenser, wherein said steam distribution manifold cylinder is attached at a first end to a turbine exhaust duct.

There is further provided according to an embodiment of the invention, a large scale field erected air cooled industrial steam condenser, wherein said steam distribution manifold is closed at both ends, and having at a bottom surface a single connection to a steam riser.

There is further provided according to an embodiment of the invention, a large scale field erected air cooled industrial steam condenser, wherein each said heat exchanger panel is independently suspended from a frame of the heat exchanger section by a plurality of flexible hanging supports.

There is further provided according to an embodiment of the invention, a large scale field erected air cooled industrial steam condenser, wherein all of the heat exchange panels in a single heat exchanger section are oriented in the same direction.

There is further provided according to an embodiment of the invention, a large scale field erected air cooled industrial steam condenser, wherein all of the heat exchange panels in a single heat exchanger section are oriented vertically.

There is further provided according to an embodiment of the invention, a large scale field erected air cooled industrial steam condenser, wherein all of the heat exchange panels in a single heat exchanger section are oriented in the same direction, at the same angle relative to vertical.

There is further provided according to an embodiment of the invention, a large scale field erected air cooled industrial steam condenser, wherein all of the heat exchange panels on one side of a single heat exchanger section are inclined relative to vertical in one direction, and all of the heat exchange panels on the other side of the single heat exchanger section are inclined relative to vertical in an opposite direction.

There is further provided according to an embodiment of the invention, a large scale field erected air cooled industrial steam condenser, said plenum section comprising a single fan resting on fan deck framework and drawing air over all of said heat exchange panels in said heat exchanger section.

There is further provided according to an embodiment of the invention, a large scale field erected air cooled industrial steam condenser, said plenum section comprising a plurality of fan deck plates resting on fan deck framework, said fan deck plates each comprising a plurality of fans.

There is further provided according to an embodiment of the invention, a large scale field erected air cooled industrial steam condenser, wherein in each fan draws air across no more than two heat exchange panels.

There is further provided according to an embodiment of the invention, a large scale field erected air cooled industrial steam condenser, wherein said flexible hanging supports each comprise a central rod connected at each end to a connection sleeve, and wherein one connection sleeve of each flexible hanging support is connected to said heat exchanger section frame and a second connection sleeve of each flexible hanging support is connected to a tube sheet of said heat exchanger panel.

There is further provided according to an embodiment of the invention, a large scale field erected air cooled industrial steam condenser, wherein said plurality of tubes in said heat exchanger panels have a length of 2.0 m to 2.8 m, a cross-sectional height of 120 mm and a cross-sectional width of 4-10 mm.

There is further provided according to an embodiment of the invention, a large scale field erected air cooled industrial steam condenser, wherein said tubes have a cross-sectional width of 5.2-7 mm.

There is further provided according to an embodiment of the invention, a large scale field erected air cooled industrial steam condenser, wherein said tubes have a cross-sectional width of 6.0 mm.

There is further provided according to an embodiment of the invention, a large scale field erected air cooled industrial steam condenser, wherein said plurality of tubes in said heat exchanger panels have fins attached to flat sides of said tubes, said fins having a height of 9 to 10 mm, and spaced at 5 to 12 fins per inch.

There is further provided according to an embodiment of the invention, a large scale field erected air cooled industrial steam condenser, wherein said plurality of tubes in said heat exchanger panels have fins attached to flat sides of said tubes, said fins having a height of 18 mm to 20 mm spanning a space between adjacent tubes and contacting adjacent tubes, said fins spaced at 5 to 12 fins per inch.

There is further provided according to an embodiment of the invention, a method of assembling a large scale field erected air cooled condenser including the steps assembling a heat exchange section at ground level, including a heat exchange section frame and said heat exchanger panels; supporting said heat exchange section at a height from ground sufficient only to suspend a steam distribution manifold section directly beneath and adjacent said heat exchanger panels, assembling a plenum section with fan deck and fan assembly at ground level; raising said assembled heat exchange section and said steam distribution manifold section and placing it atop a corresponding understructure; attaching adjacent steam distribution manifold sections to one-another; and raising said assembled plenum section and placing it atop said heat exchange section.

There is further provided according to an embodiment of the invention, a large scale field erected air cooled industrial steam condenser, optionally connected to an industrial steam producing facility, including: a single or plurality of condenser streets, each condenser street comprising a row of condenser modules, each condenser module comprising a plenum section having single fan or multiple fans drawing air through a plurality of heat exchanger panels supported in a heat exchange section, and each heat exchanger panel having a longitudinal axis and a transverse axis perpendicular to its longitudinal axis, each heat exchanger panel comprising a plurality of condenser tubes and a top bonnet connected to and in fluid communication with a top end of each said plurality of condenser tubes, a bottom bonnet connected to and in fluid communication with a bottom end of each said plurality of condenser tubes, each said bottom bonnet having a single steam inlet; each said condenser street having a single steam distribution manifold suspended from and directly adjacent to a bottom side of said heat exchanger section arranged along an axis that is perpendicular to a longitudinal axis of said heat exchanger panels at a midpoint of said heat exchanger panels and extending a length of said condenser street, said steam distribution manifold comprising a cylinder attached at a first end to a turbine exhaust duct, and closed at a second end distal from said first end, said cylinder having at its top surface a plurality of connections adapted to connect to said bottom bonnet inlets.

BRIEF DESCRIPTION OF THE DRAWINGS

FIG. 18A is a set of engineering drawings showing a hanger rod according to an embodiment of the invention in a cold position.

FIG. 18B is a set of engineering drawings showing the hanger rod of FIG. 18A in a hot position.

FIG. 19A is a set of engineering drawings showing a hanger rod according to a different embodiment of the invention in a cold position.

FIG. 19B is a set of engineering drawings showing the hanger rod of FIG. 19A in a hot position.

Figure 1:
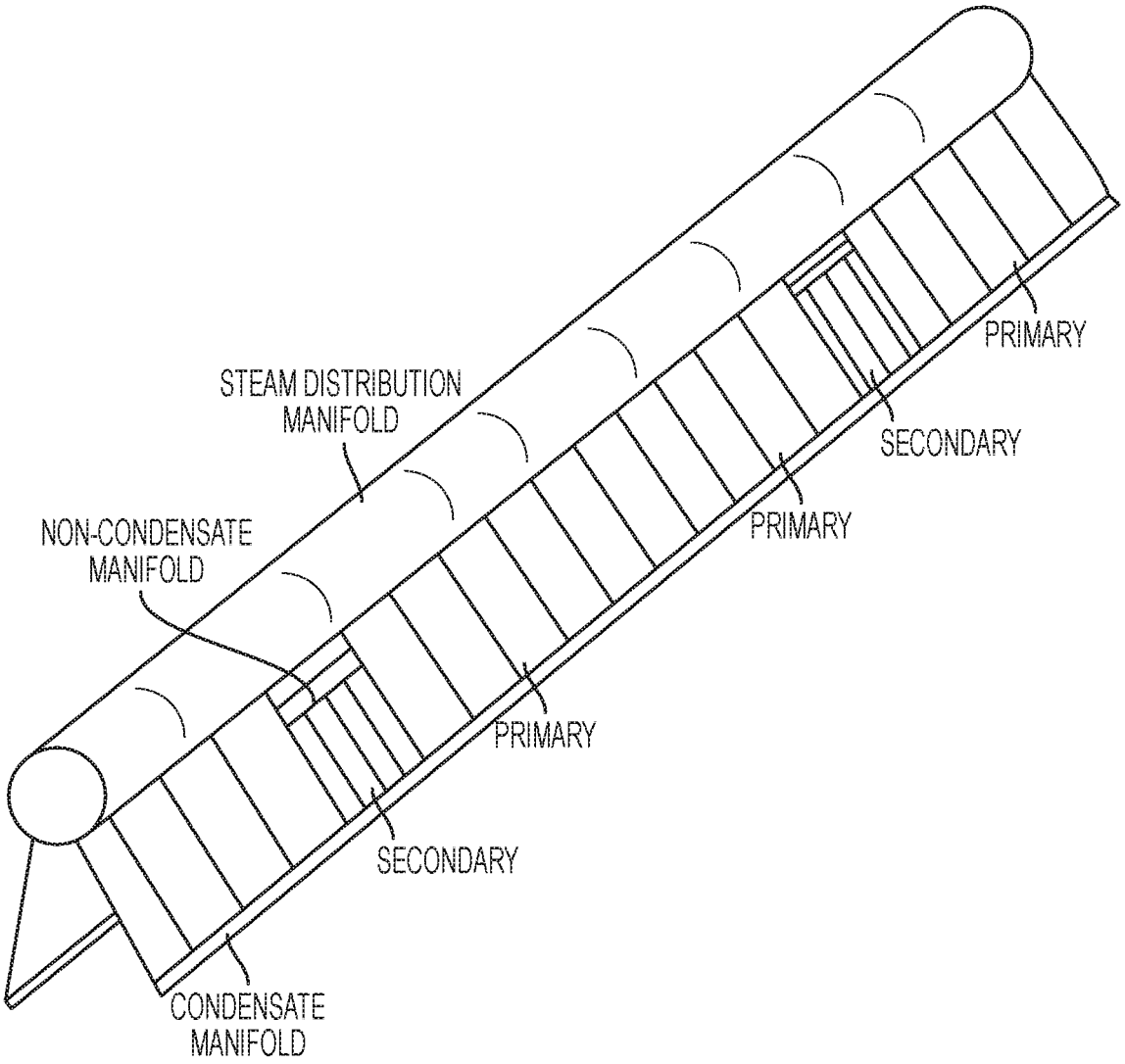
FIG. 1 PRIOR ART
FIG. 1 is a perspective view representation of the heat exchange portion of a prior art large scale field erected air cooled industrial steam condenser.
Figure 2:
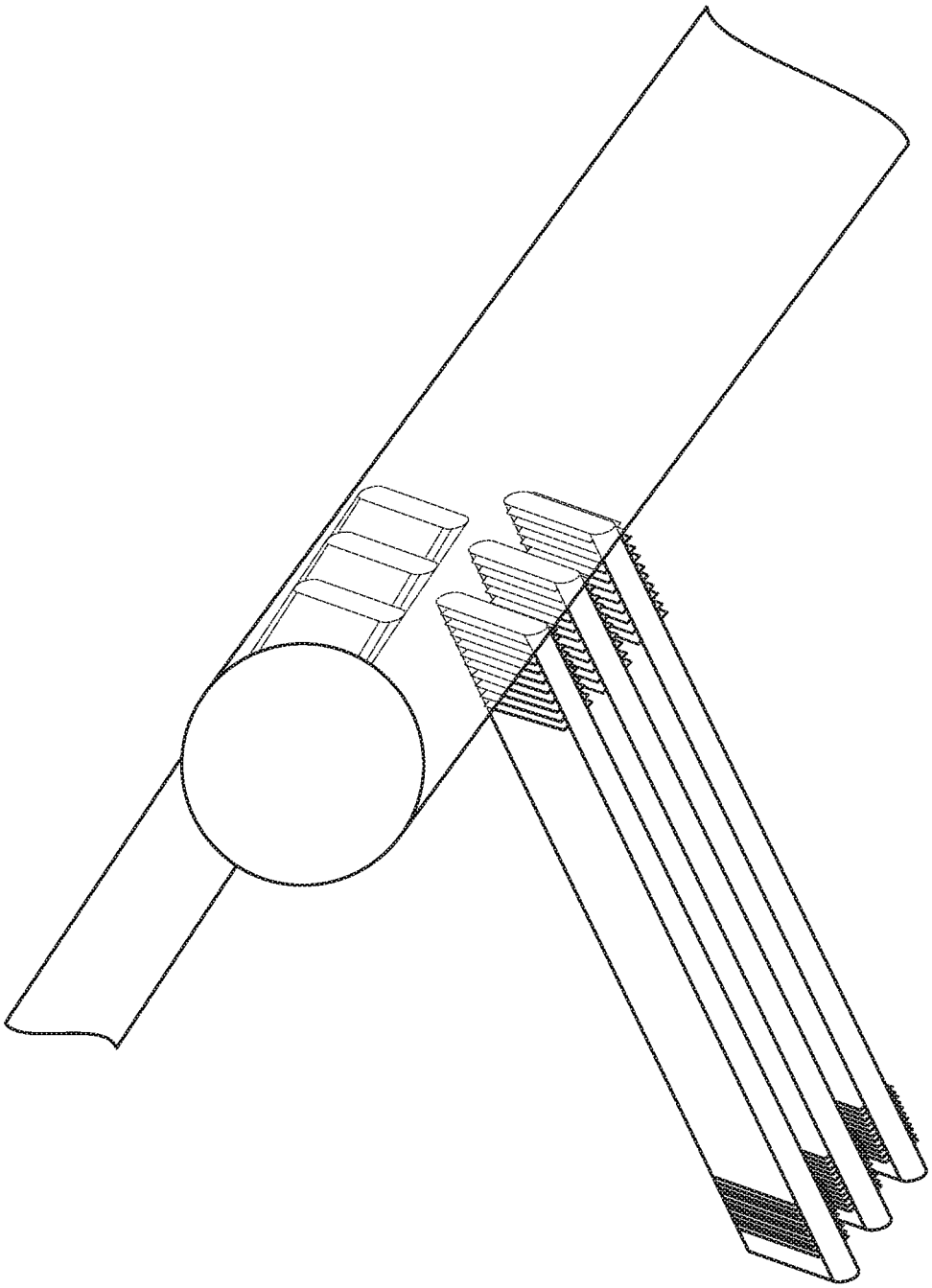
FIG. 2 PRIOR ART
FIG. 2 is a partially exploded close up view of the heat exchange portion of a prior art large scale field erected air cooled industrial steam condenser, showing the orientation of the tubes relative to the steam distribution manifold.
Figure 3:
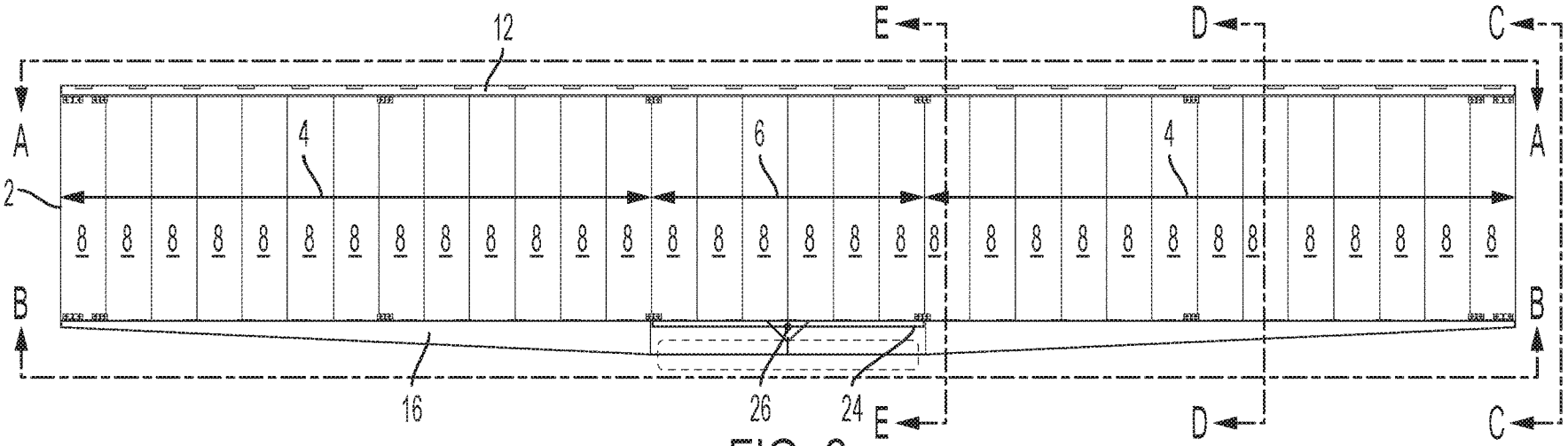
FIG. 3 is a side view of a two stage heat exchanger panel according to an embodiment of the invention.
Figure 4:
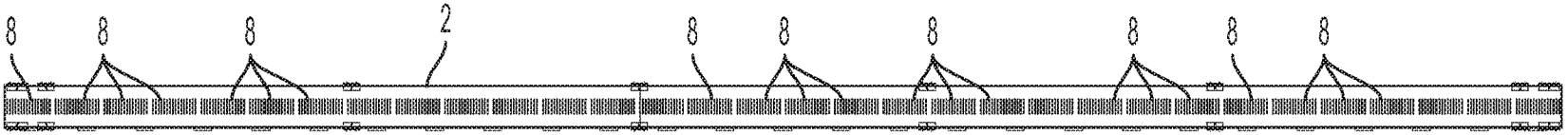
FIG. 4 is a top view of the heat exchanger panel shown in FIG. 3.
Figure 5:
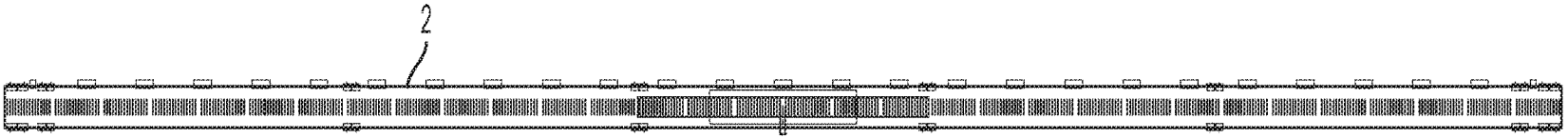
FIG. 5 is a bottom view of the heat exchanger panel shown in FIG. 3.
Figure 8:
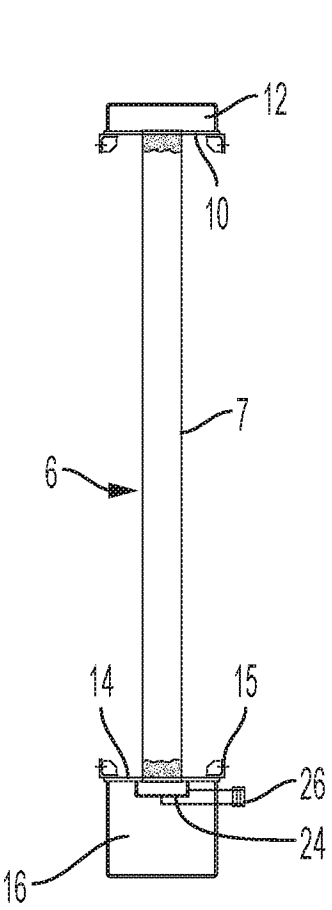
FIG. 8 is a cross-sectional view of the heat exchanger panel shown in FIG. 3, along line E-E.
Figure 7:
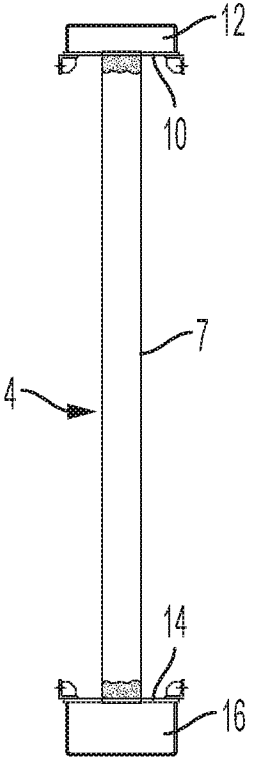
FIG. 7 is a cross-sectional view of the heat exchanger panel shown in FIG. 3, along line D-D.
Figure 6:
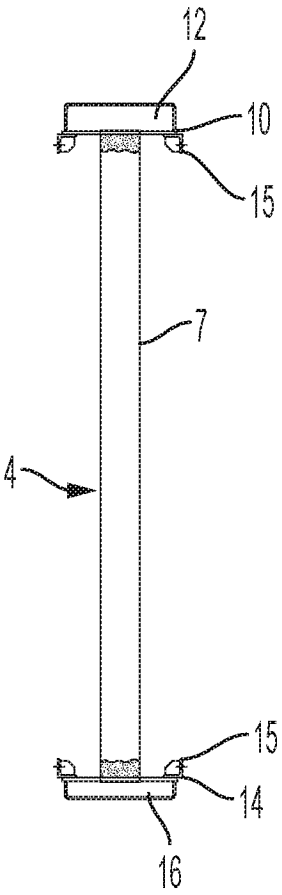
FIG. 6 is a cross-sectional view of the heat exchanger panel shown in FIG. 3, along line C-C.
Figure 9:
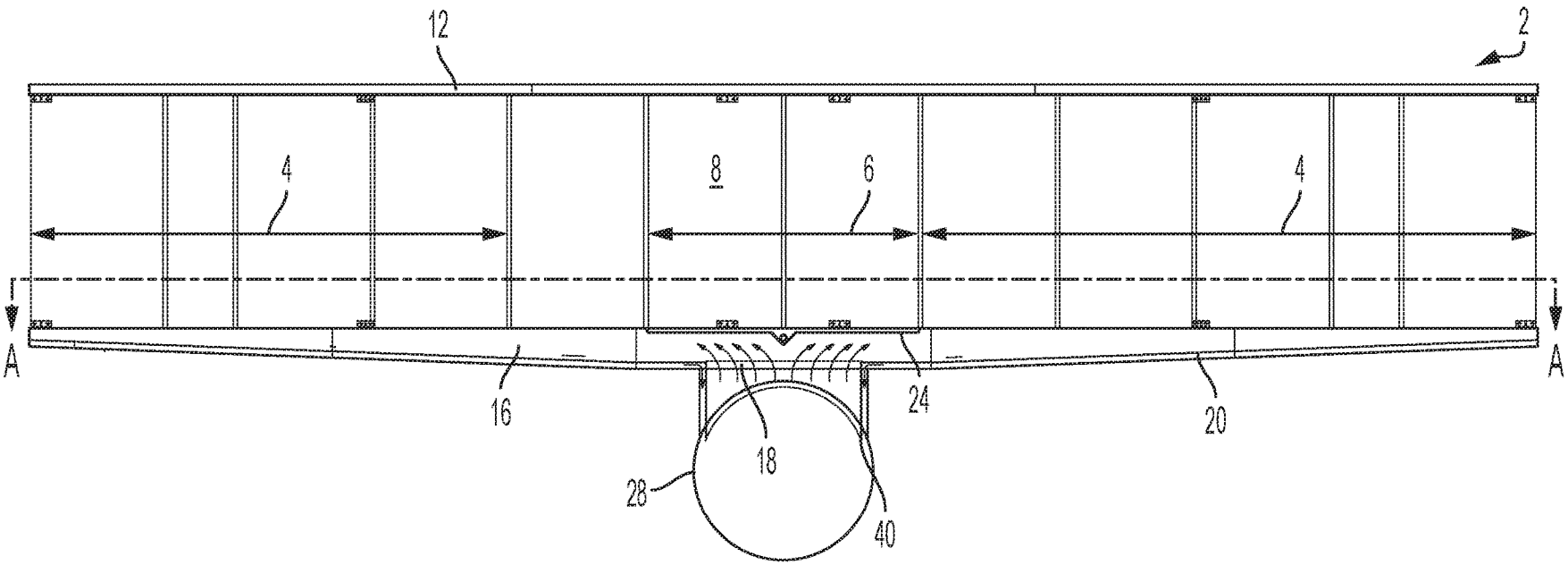
FIG. 9 is a side elevation view of a two stage heat exchanger panel and upper steam distribution manifold according to an alternate embodiment of the invention.
Figure 10A:
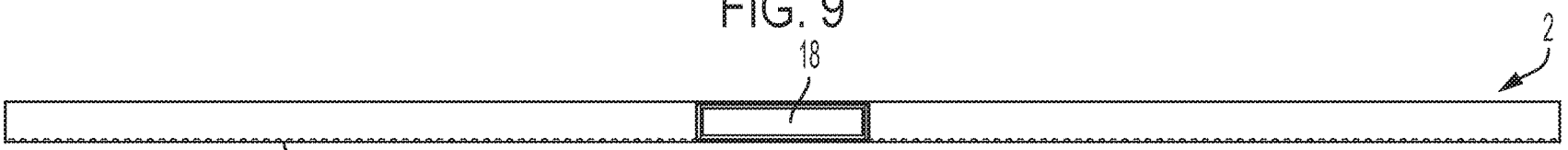
FIG. 10A is a Section view along line A-A of FIG. 9.
Figure 10B:
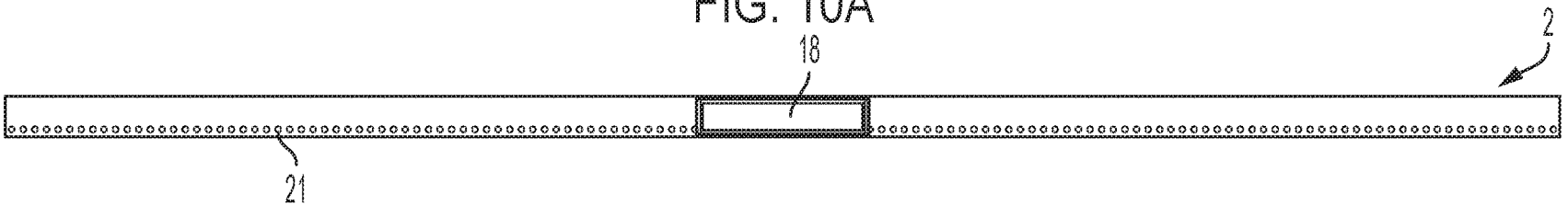
FIG. 10B is alternative embodiment to the embodiment shown in FIG. 10A.

Features in the attached drawings are numbered with the following reference numerals:

| |
|---|
| 2 heat exchanger panel |
| 4 primary condenser section |
| 6 secondary condenser section |
| 7 tubes |
| 8 condenser bundles |
| 10 top tube sheet |
| 12 top bonnet |
| 14 bottom tube sheet |
| 15 lifting/support angle |
| 16 bottom bonnet |
| 18 stem inlet/condensate outlet |
| 20 shield plate |
| 21 perforations |
| 22 scalloped edge |
| 24 secondary bottom bonnet |
| 26 nozzle (for secondary bottom bonnet) |
| 27 ACC condenser module (cell) |
| 28 upper steam manifold |
| 29 Y-shaped nozzle |
| 30 riser (LSM to USM) |
| 31 turbine exhaust duct |
| 32 lower steam distribution manifold |
| 34 street/row of ACC cells |
| 36 frame (of heat exchange section) |
| 37 heat exchange module |
| 40 deflector shield |
| 42 condensate piping |
| 50 hangers |
| 54 hanger rod |
| 56 hanger sleeve |
| 58 hanger fixed discs or knobs |
| 60 hanger recesses |
| 62 understructure module |
| 64 plenum section module |
| 66 elevated steam distribution manifold |
| 68 elevated turbine exhaust duct |
| 70 air deflection seal |
| 72 fan deck plate |
| 74 small fan |
| 76 ground level turbine exhaust duct |
| 78 end riser (GLTED to ESDM) |

DETAILED DESCRIPTION

Figure 12:
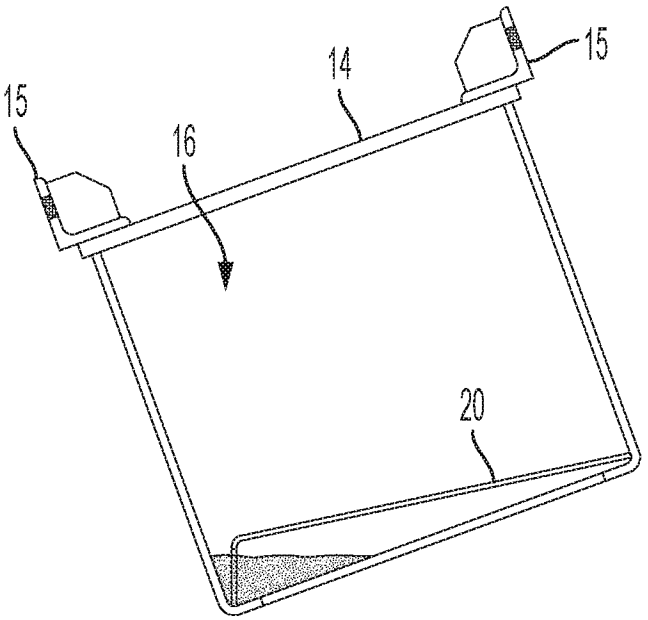
FIG. 12 is a cross-sectional view of a bottom bonnet of the type shown in FIG. 9 with a bended shield plate according to an embodiment of the invention.
Figure 11:
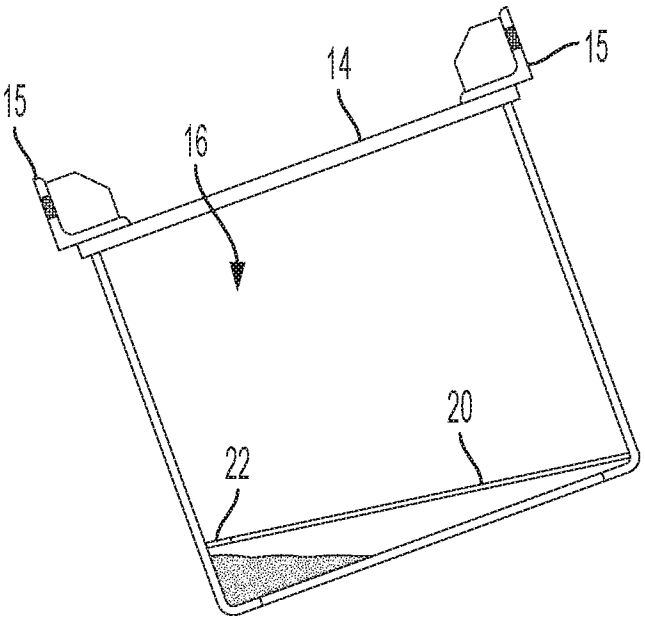
FIG. 11 is a cross-sectional view of a bottom bonnet of the type shown in FIG. 9 with a flat shield plate according to an embodiment of the invention.
Figure 13A:
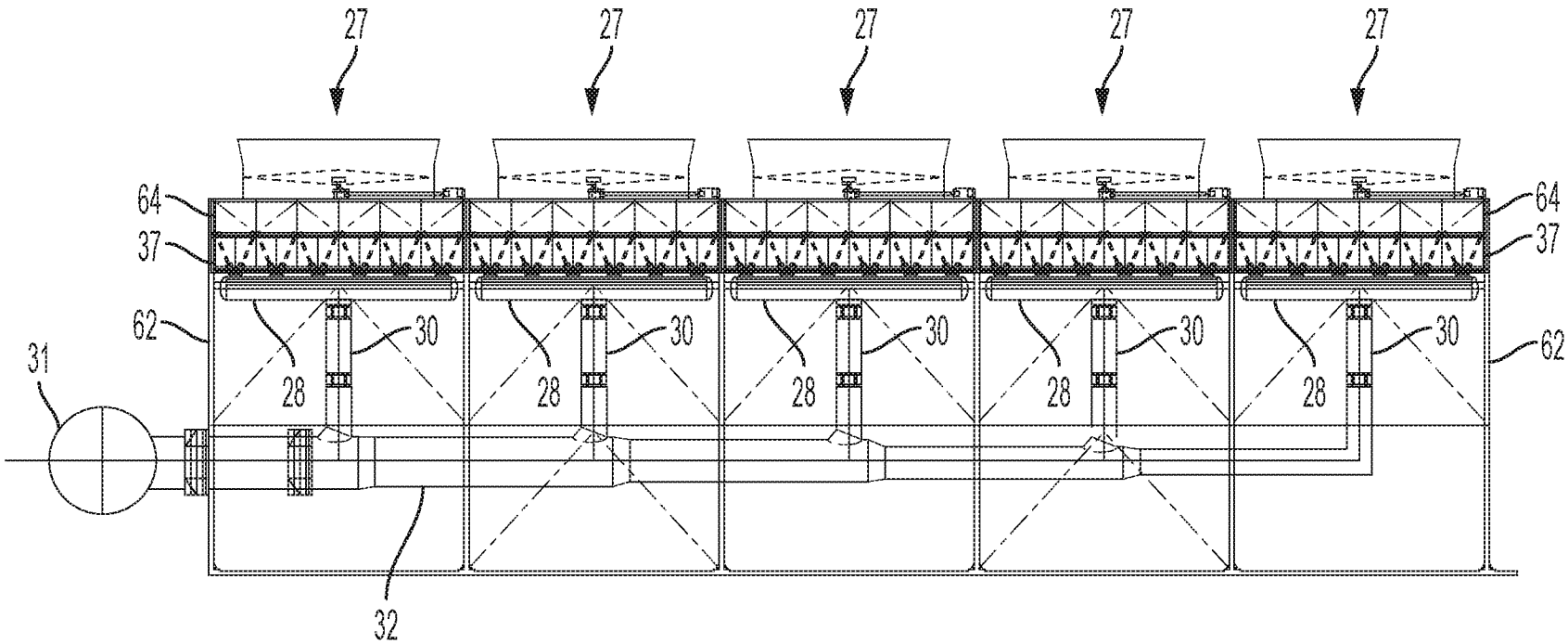
FIG. 13A is a side view of a large scale field erected air cooled industrial steam condenser according to an embodiment of the invention with new steam delivery and distribution configuration.
Figure 13B:
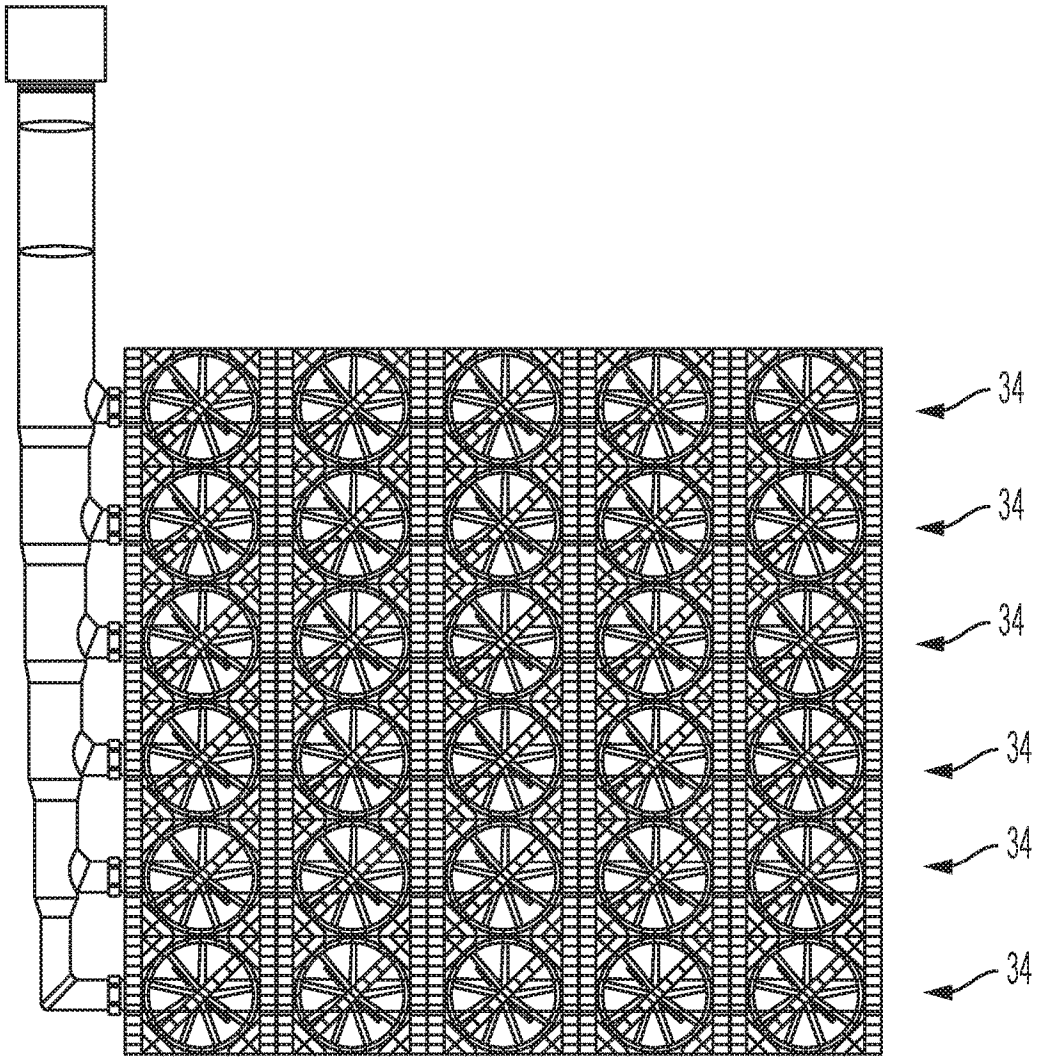
FIG. 13B is a plan view of a large scale field erected air cooled industrial steam condenser shown in FIG. 13A.
Figure 14:
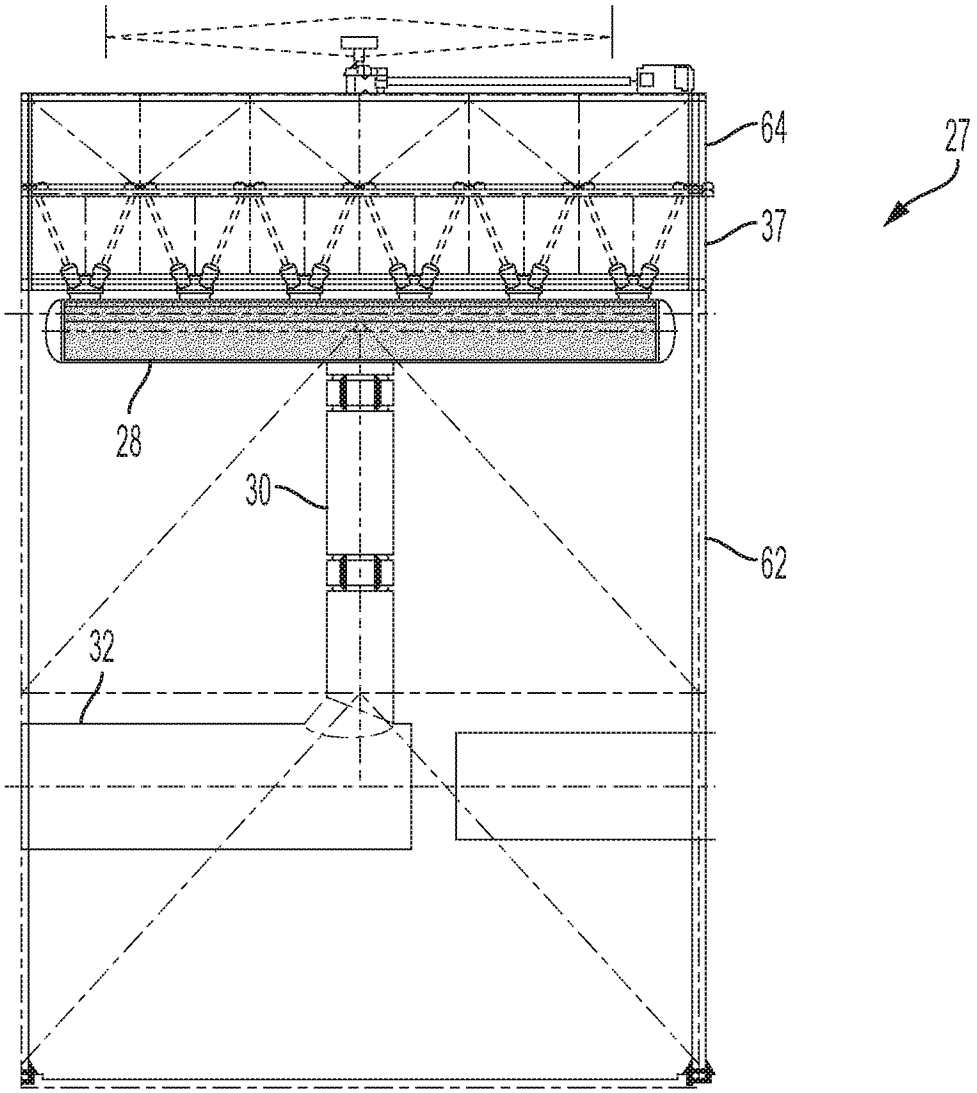
FIG. 14 is a closeup side view of one cell of the large scale field erected air cooled industrial steam condenser shown in FIGS. 13A and 13B.
Figure 15:
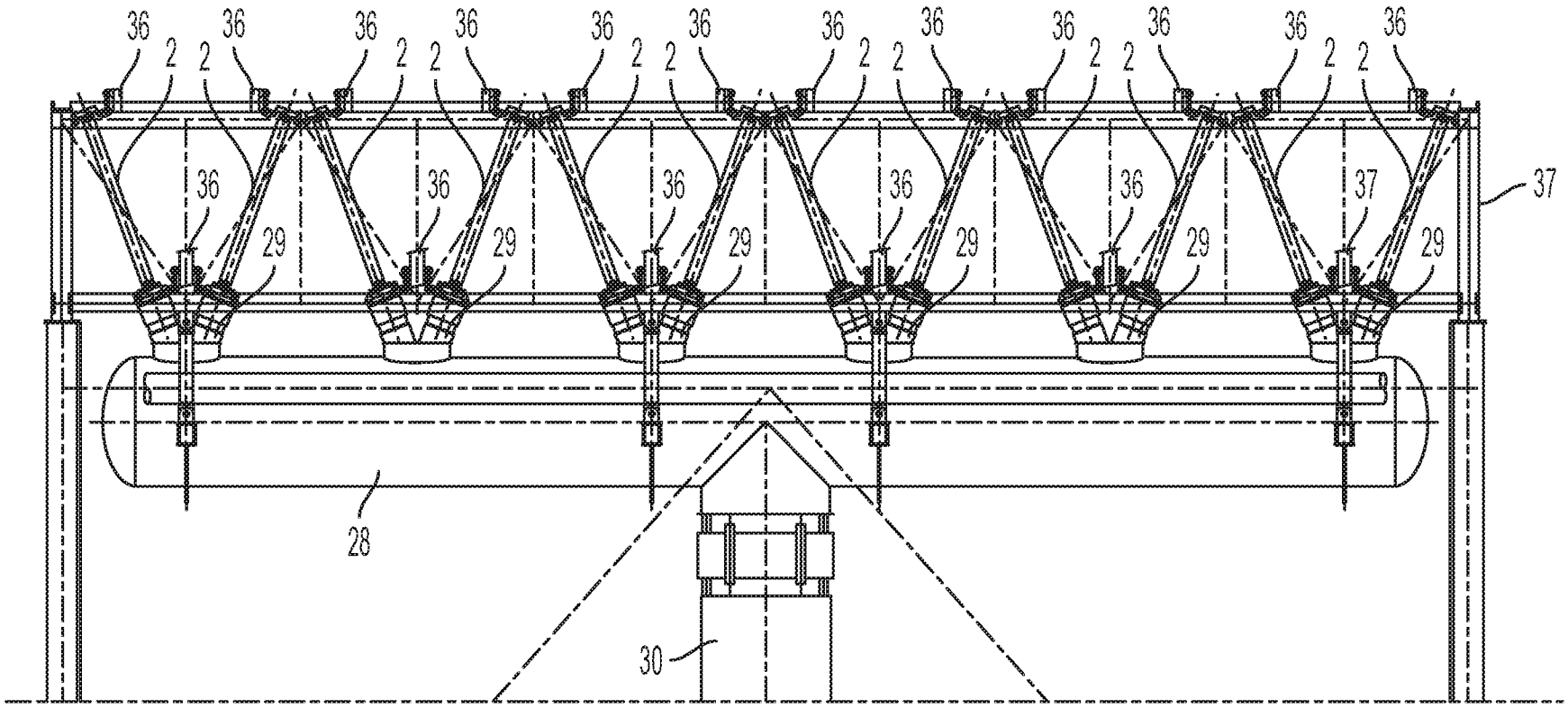
FIG. 15 is a further closeup side view of one cell of the large scale field erected air cooled industrial steam condenser shown in FIGS. 13A, 13B and 14.

Referring FIGS. 3-8, the heat exchanger panel 2 according to a first embodiment of the present invention includes two primary condenser sections 4 flanking an integrated and centrally located secondary condenser section 6. Each heat exchanger panel 2 consists of a plurality of separate condenser bundles 8, with a first subset of condenser bundles 8 making up the centrally located secondary section 6, and a second subset of different condenser bundles 8 making up each flanking primary section 4. The dimensions and constructions of the tubes 7 of the primary and secondary sections are preferably identical. At their top, all of the tubes 7 of both the primary and secondary sections 4, 6 are joined to a top tube sheet 10, on which sits a hollow top bonnet 12 which runs the length of the top of the heat exchanger panel 2. The bottom of all of the tubes 7 of the primary and secondary sections 4, 6 are connected to a bottom tube sheet 14, which forms the top of a bottom bonnet 16. The bottom bonnet 16 likewise runs the length of the heat exchanger panel 2. The bottom bonnet 16 is in direct fluid communication with the tubes 7 of the primary section 4 but not with the tubes of the secondary section 6. The bottom bonnet 16 is fitted at the center point of its length with a single steam inlet/condensate outlet 18 which receives all the steam for the heat exchanger panel 2 and which serves as the outlet for condensate collected from the primary sections 4. The bottom of the bottom bonnet 16 is preferably angled downward at an angle of between 1 degree and 5 degrees, preferably about 3 degrees with respect to the horizontal from both ends of the bonnet 16 toward the steam inlet/condensate outlet 18 at the middle of the heat exchanger panel 2. According to a preferred embodiment and referring to FIGS. 9-12, the bottom bonnet 16 may include a shield plate 20 to partition condensate flow from the steam flow. The shield 20 may have perforations 21 and/or have a scalloped edge 22 or have other openings or configuration to allow condensate falling on top of the shield 20 to enter the space beneath the shield and to flow beneath the shield toward the inlet/outlet 18. When viewed from the end of the bottom bonnet 16, the shield plate 20 is secured at a near-horizontal angle (between horizontal and 12 degrees from horizontal in the crosswise direction) so as to maximize the cross-section provided by the bottom bonnet 16 to the flow of steam. The shield plate 20 may be flat as shown in FIG. 11 or bended as shown in FIG. 12. The top tube sheet 10 and bottom tube sheet 14 may be fitted with lifting/support angles 15 for lifting and/or supporting the heat exchangers 2.

An internal secondary chamber, or secondary bottom bonnet 24, is fitted inside the bottom bonnet 16 in direct fluid connection with only the tubes 7 of the secondary section 6 and extends the length of the secondary section 6, but preferably not beyond. This secondary bottom bonnet 24 is fitted with a nozzle 26 to withdraw non-condensables and condensate.

Figure 34:
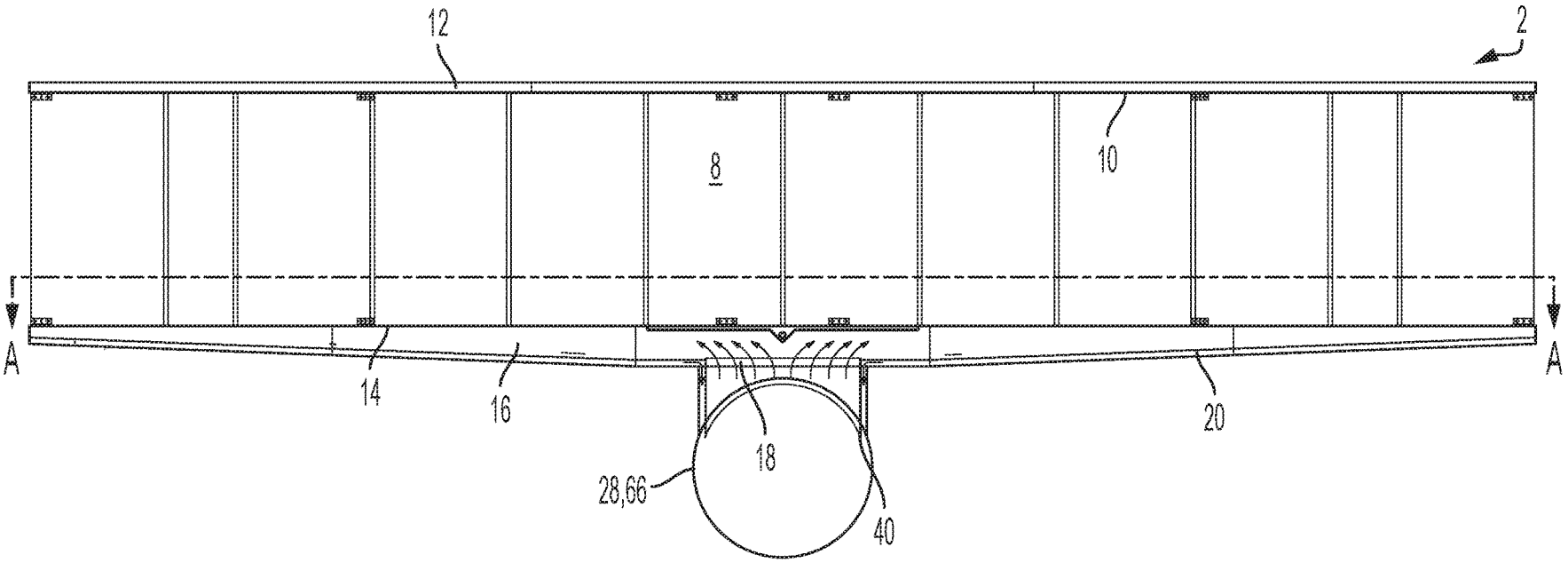
FIG. 34 is a side elevation view of a single stage heat exchanger panel and upper steam distribution manifold according to an alternate embodiment of the invention.

According to an alternate, single stage condenser, embodiment shown in FIG. 34, there is no secondary section or secondary bottom bonnet, and the bottom bonnet 16 is in direct fluid communication with all of the tubes in the heat exchange panel 2. According to this embodiment, bottom bonnet 16 runs along the bottom length of the heat exchanger panel 2 connected to the bottom side of the bottom tube sheet 14. Bottom bonnet 16 delivers steam to the bottom end of all the tubes of condenser bundles 8 in the heat exchanger panel 2. The tops of all of the tubes are connected to a top tube sheet 10, which in turn is connected on its top side to a top bonnet 12. Uncondensed steam and non-condensables flow into the top bonnet 12 from all of the tubes 7 in the heat exchange panel 2 and are drawn away from the top bonnet 12 for further processing. Condensate flows out the bottom of all of the tubes 7 into the bottom bonnet 16, and into the steam distribution manifold.

The steam inlet/condensate outlet 18 for the heat exchanger panel 2 and the steam inlet/condensate outlets 18 for all of the heat exchanger panels in the same ACC cell/module 27 are connected to a large cylinder or upper steam distribution manifold 28 suspended beneath the heat exchanger panels 2 and which runs perpendicular to the longitudinal axis of the heat exchanger panels 2 at their midpoint. See, e.g., FIGS. 13-15, 20A and 20B. The upper steam distribution manifold 28 extends across the width of the cell/module 27 and is closed at both ends. At its bottom center, the upper steam distribution manifold 28 is connected to a single riser 30 which is connected at its bottom to the lower steam distribution manifold 32. Where the top surface of the upper steam distribution manifold 28 passes below the center point of each heat exchanger panel 2, the upper steam distribution manifold 28 is fitted with a Y-shaped nozzle 29 which connects to the steam inlet/condensate outlets 18 at the bottom of each adjacent pair of heat exchanger panels 2.

According to this construction, each cell 27 of the ACC receives steam from a single riser 30. The single riser 30 feeds steam to a single upper steam distribution manifold 28 suspended directly beneath the center point of each heat exchanger panel 2, and the upper steam distribution manifold 28 feeds steam to each of the heat exchanger panels 2 in a cell 27 via a single steam inlet/condensate outlet 18.

Figure 16:
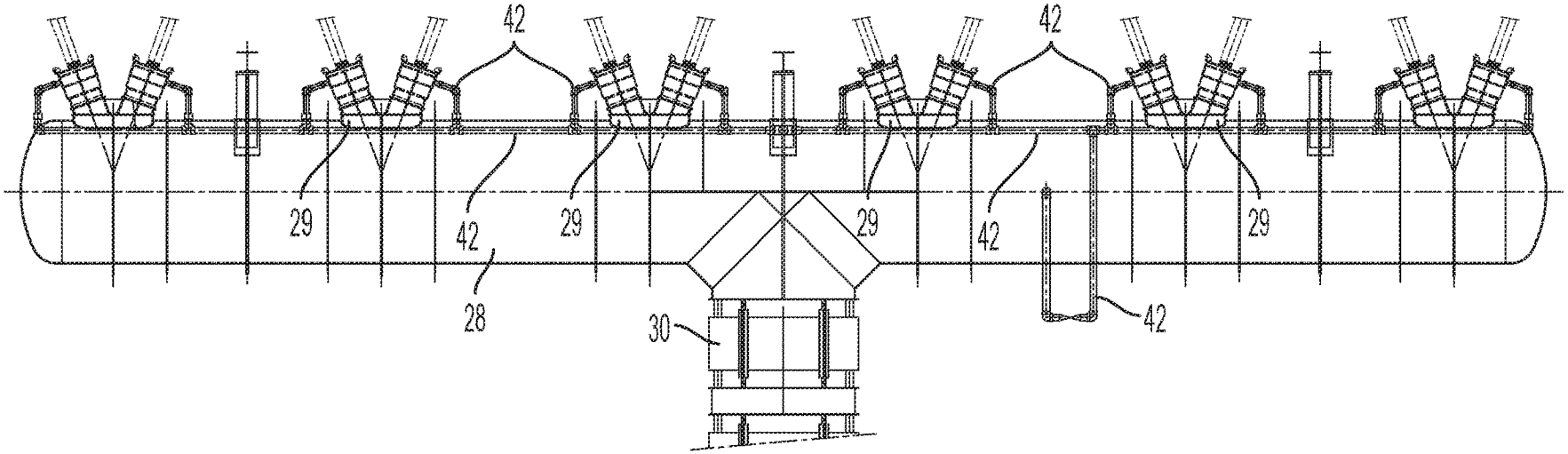
FIG. 16 is an elevation view of the upper steam distribution manifold and its connections to the heat exchanger panels, including optional condensate piping from the secondary bottom bonnet (in the case of a two stage condenser panel) according to an embodiment of the invention.

Therefore, the steam from an industrial process travels along the turbine exhaust duct 31 at or near ground level, or at any elevation(s) suited to the site layout. When the steam duct 31 approaches the ACC of the invention, it splits into a plurality of sub-ducts (lower steam distribution manifolds 32), one for each street (row of cells) 34 of the ACC. Each lower steam distribution manifold 32 travels beneath its respective street of cells 34, and it extends a single riser 30 upwards at the center point of each cell 27. See, e.g., FIGS. 13A and 13B. The single riser 30 connects to the bottom of the upper steam distribution manifold 28 suspended from the frame 36 of the condenser module 37, FIGS. 13-15. The upper steam distribution manifold 28 delivers steam through a plurality of Y-shaped nozzles 29 to the pair of bonnet inlets/outlets 18 of each adjacent pair of heat exchanger panels 2, FIGS. 15-17. The steam travels along the bottom bonnet 16 and up through the tubes 7 of the primary sections 4, condensing as air passes across the finned tubes 7 of the primary condenser sections 4. The condensed water travels down the same tubes 7 of the primary section 4 countercurrent to the steam, collects in the bottom bonnet 16 and eventually drains back through the upper steam distribution manifold 28 and lower steam distribution manifold 32 and turbine exhaust duct 31 to a condensate collection tank (not shown). According to a preferred embodiment, the connection between the bottom bonnet 16 and the upper steam distribution manifold 28 may be fitted with a deflector shield 40 to separate the draining/falling condensate from the incoming steam.

The uncondensed steam and non-condensables are collected in the top bonnet 12 and are drawn to the center of the heat exchanger panel 2 where they travel down the tubes 7 of the secondary section 6 co-current with the condensate formed therein. Non-condensables are drawn into the secondary bottom bonnet 24 located inside the bottom bonnet 16 and out through an outlet nozzle 26. Additional condensed water formed in the secondary section 6 collects in the secondary bottom bonnet 24 and travels through the outlet nozzle 26 as well and then travels through condensate piping 42 to the upper steam distribution manifold 28 to join the water collected from the primary condenser sections 4.

Figure 17:
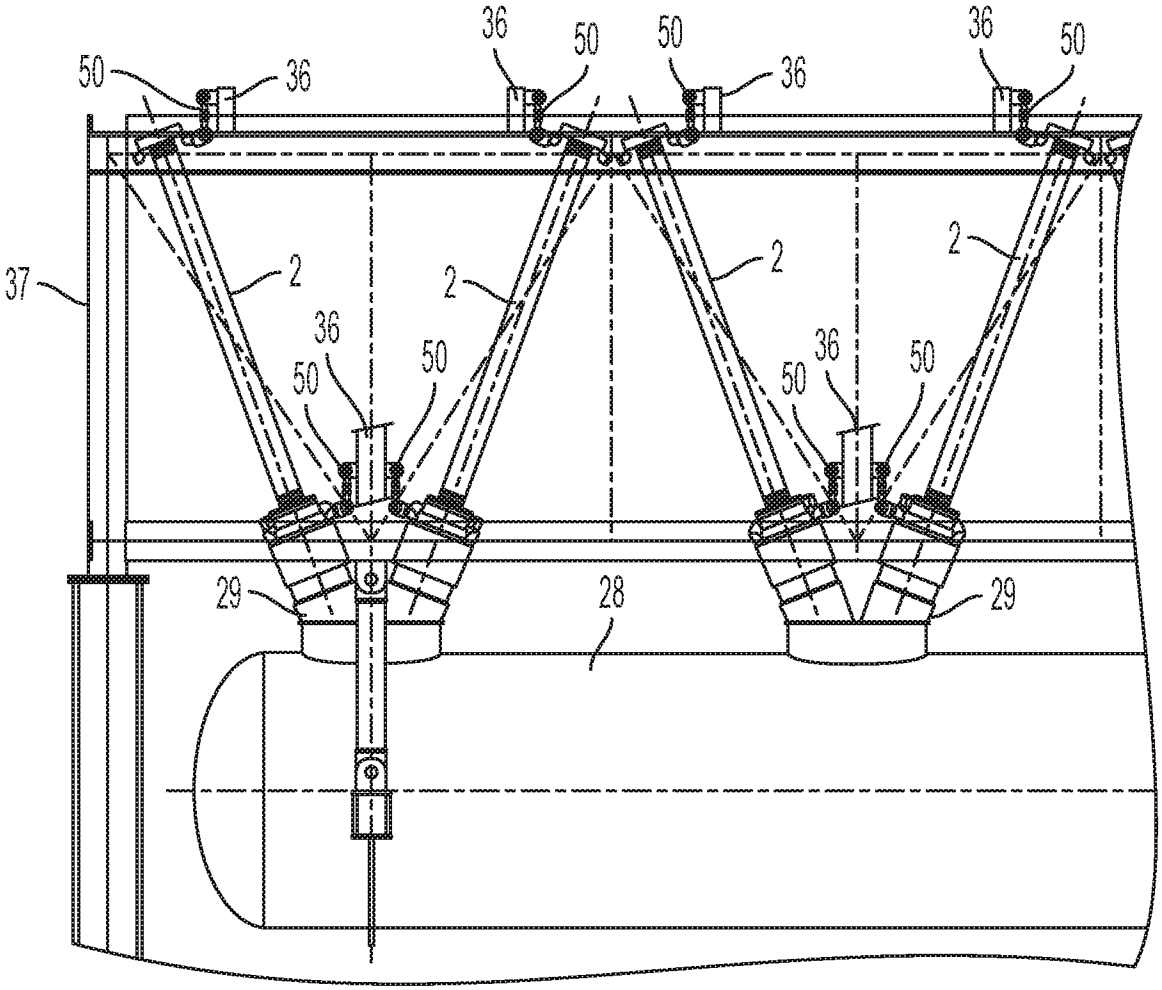
FIG. 17 is a further closeup side view of one cell of the large scale field erected air cooled industrial steam condenser shown in FIGS. 13-15, showing an end view of two pairs of heat exchanger panels.
Figure 20A:
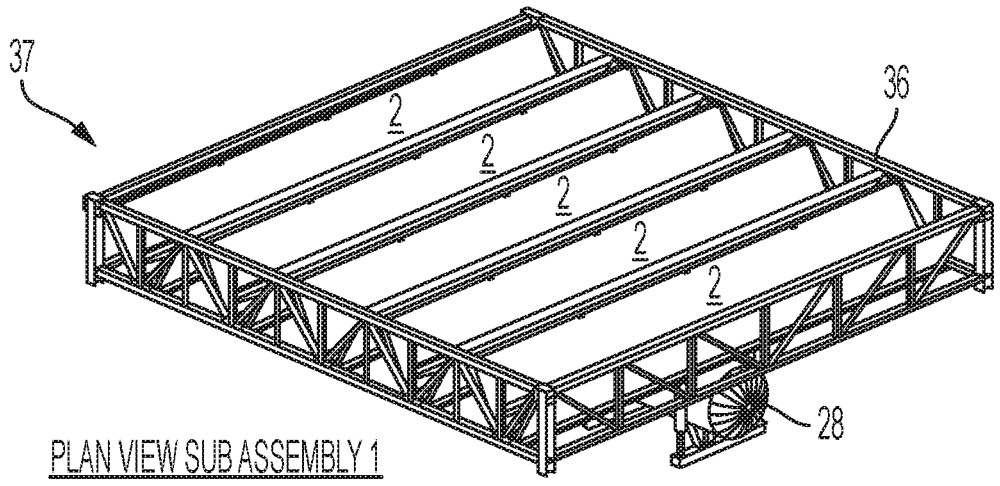
FIG. 20A shows a top perspective view of a single pre-assembled condenser module including the upper steam distribution manifold suspended therefrom.
Figure 20B:
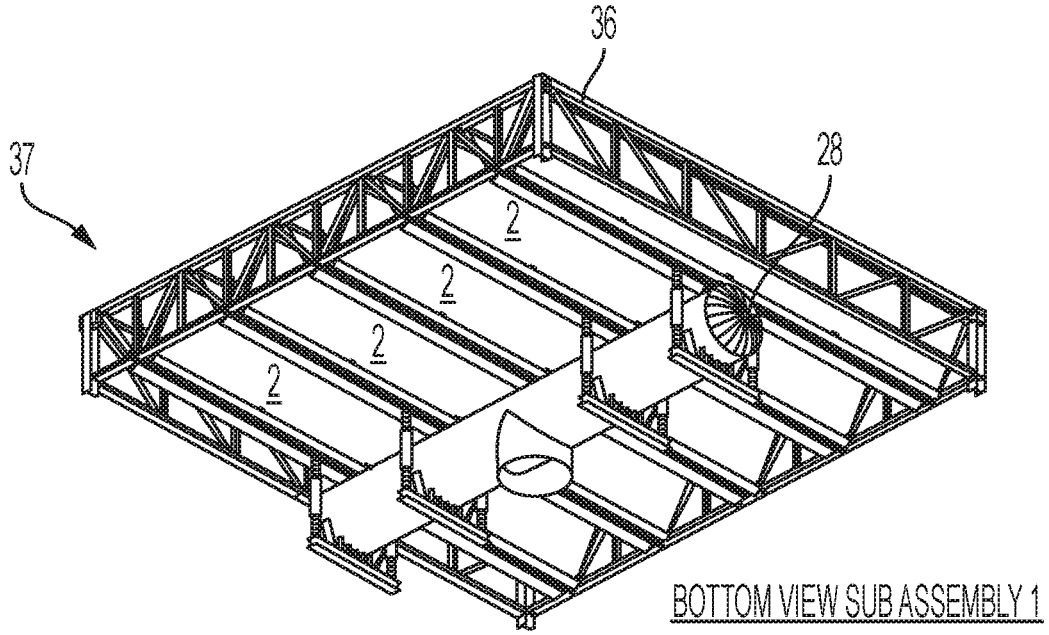
FIG. 20B shows a bottom perspective view of a single pre-assembled condenser module including the upper steam distribution manifold suspended therefrom.
Figure 21A:
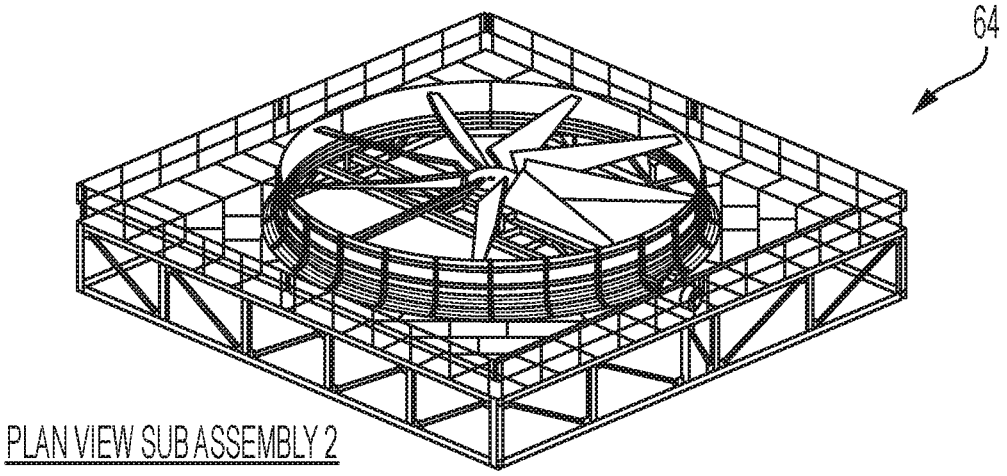
FIG. 21A shows a top perspective view of a fan deck and fan (plenum) subassembly for a single cell corresponding to the condenser module shown in FIGS. 20A and 20B.
Figure 21B:
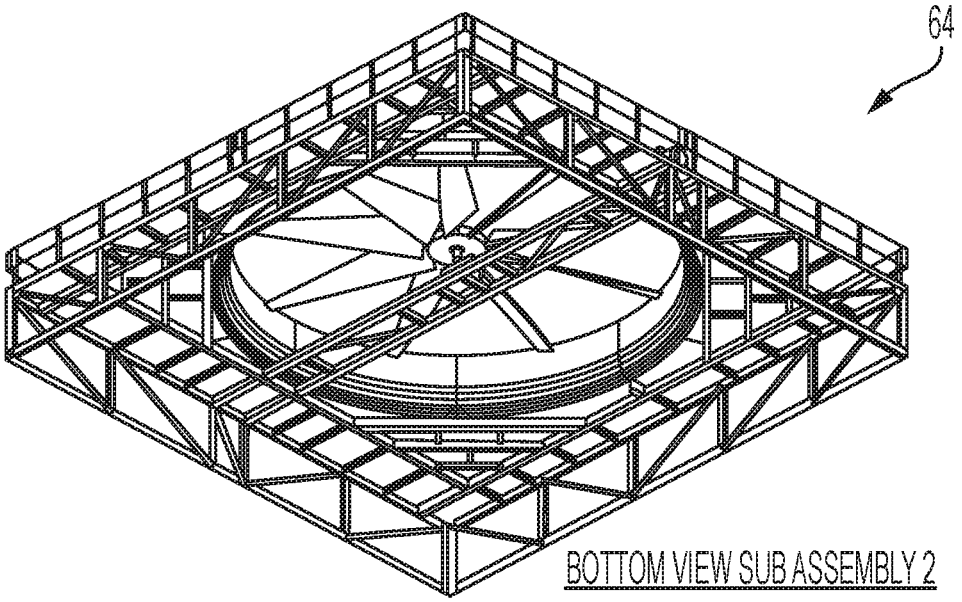
FIG. 21B shows a bottom perspective view of a fan deck and fan (plenum) subassembly for a single cell corresponding to the condenser module shown in FIGS. 20A and 20B.

According to another feature of the invention, the heat exchanger panels 2 are suspended from framework 36 of the condenser module 37 by a plurality of flexible hangers 50 which allow for expansion and contraction of the heat exchanger panels 2 based on heat load and weather. FIG. 17 shows how the hangers 50 are connected to the frame 36 of the condenser module 37, and FIGS. 18A, 18B, 19A and 19B shows the details of two embodiments of the hangers. According to each embodiment, the hanger 50 is constructed to allow the heat exchanger panel 2 to expand or contract while providing support for their weight. Four hangers 50 are used for each heat exchanger panel 2. According to one embodiment, the hanger 50 is constructed of a rod 54 with sleeves 56 at each end. The sleeves 56 are fitted over the rod 54 and are prevented from coming off of the respective ends by fixed discs or knobs 58 at each end of the rod 54 which fit into correspondingly shaped recesses 60 on the inside surface of the respective sleeves, but which recesses do not extend to the end of the sleeve. One end of the hanger 50 is connected to the frame 36 of the condenser module 37 and the other end of the hanger is attached to an lifting/support angle 15 or other attachment point on the top tube sheet 10 or bottom tube sheet 14. The sleeves 56 are preferably adjustable to allow for the setting of correct hanger length during construction. Once set, movement of the heat exchanger panels 2 is accommodated by the ball joints at the top and bottom of the hangers 50 and the angular displacement of the hangers 50.

Figure 28:
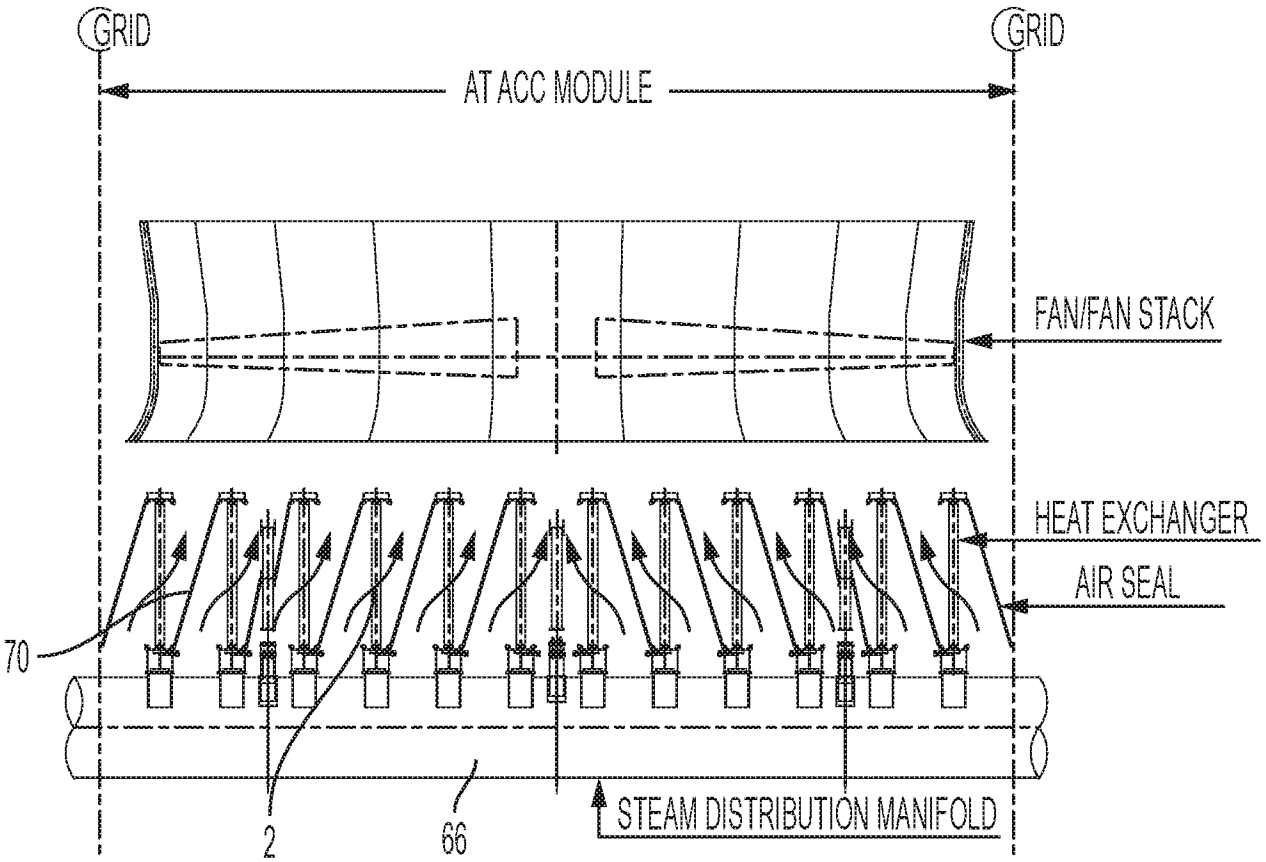
FIG. 28 is an elevation view of an alternate embodiment of the invention in which all of the heat exchange panels in a heat exchange module are oriented vertically, with an air deflection seal situated between each adjacent pair of panels.
Figure 29:
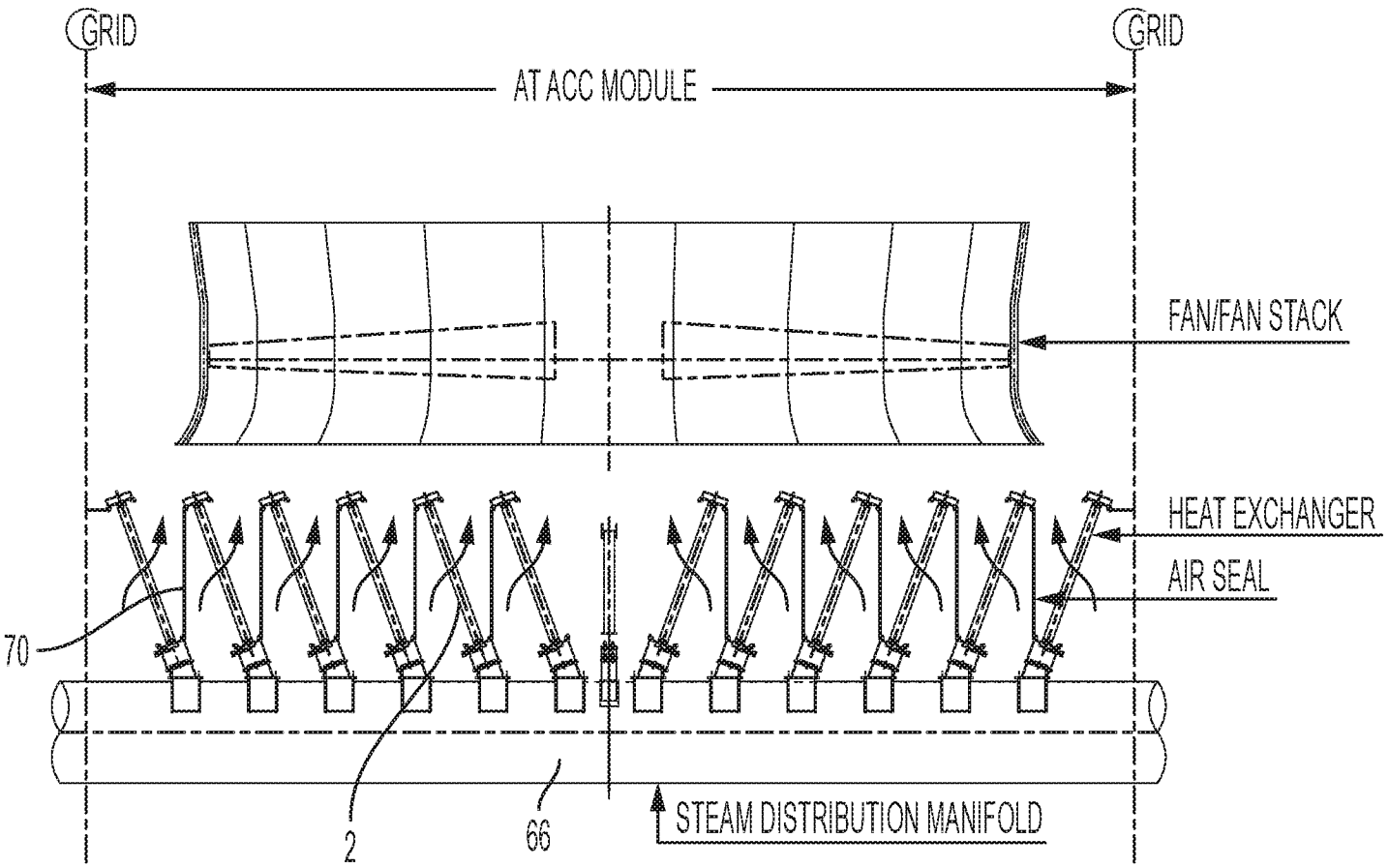
FIG. 29 is an elevation view of another embodiment of the invention in which all of the heat exchange panels on one side of a heat exchange module are inclined relative to vertical in one direction, and all of the heat exchange panels on the other side of the heat exchange module are inclined relative to vertical in the opposite direction.

The heat exchange panels 2 may each be independently loaded into and supported in heat exchange module framework 36. The heat exchange panels 2 may be supported in the heat exchange module framework 36 according to any of a variety of configurations. FIGS. 13-17, 23-27 show the heat exchange panels 2 independently supported in the heat exchange module framework 36 with adjacent heat exchange panels 2 inclined relative to vertical in opposite directions. FIG. 28 shows an alternate embodiment in which each heat exchange panel 2 is independently supported in the heat exchange module with each heat exchange panel oriented vertically, and an optional air deflection seal 70 positioned at an incline between a bottom of one heat exchange panel 2 and a top of an adjacent heat exchange panel 2. FIG. 29 shows a further alternate embodiment in which each heat exchange panel 2 on one side of the heat exchange module is inclined relative to vertical in one direction, and each heat exchange panel 2 on the other side of the heat exchange module is inclined relative to vertical in the opposite direction, with an optional air deflection seal 70 vertically positioned between each pair of adjacent exchange panels 2.

Figure 25:
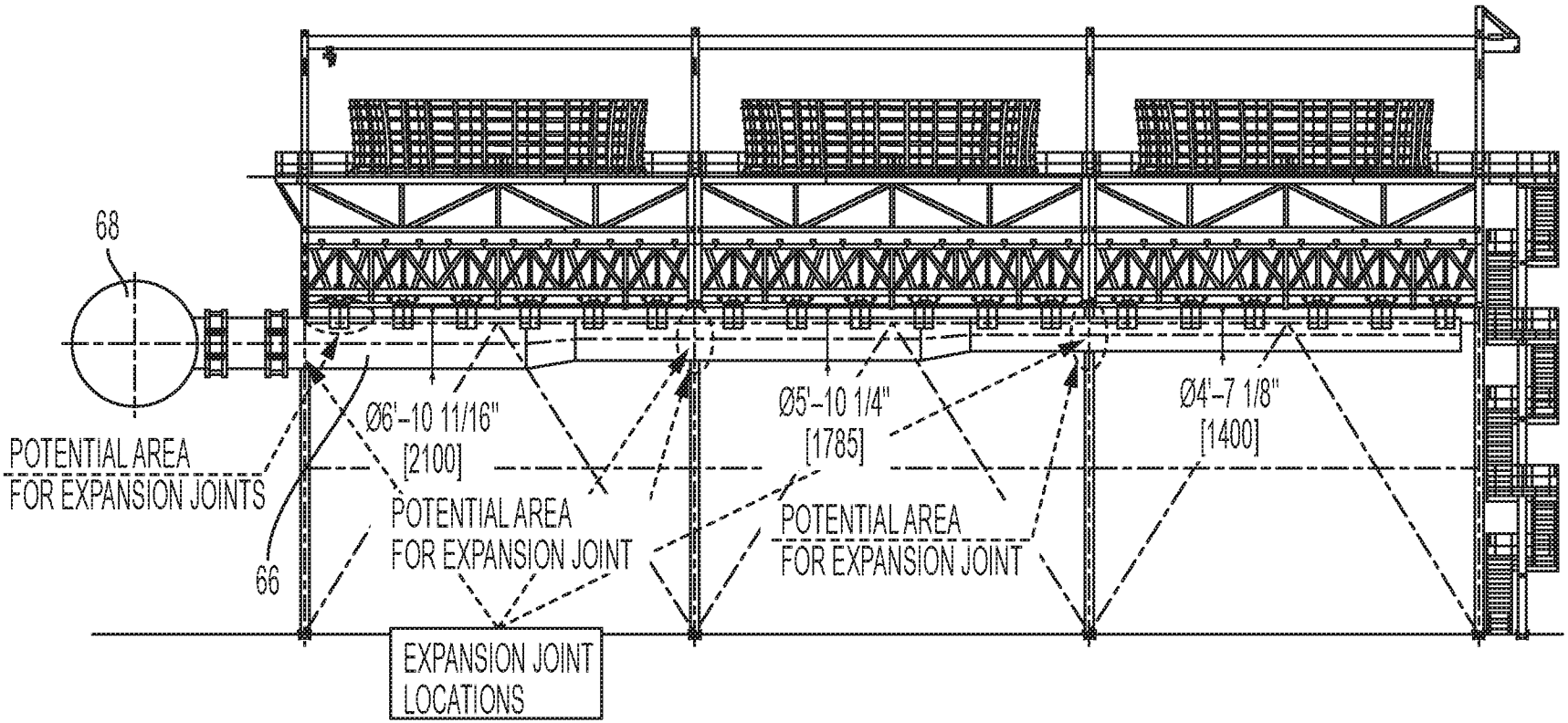
FIG. 25 is side view of a large scale field erected air cooled industrial steam condenser according to an alternate embodiment of the invention having elevated steam distribution manifolds directly connected to the turbine steam duct.
Figure 26:
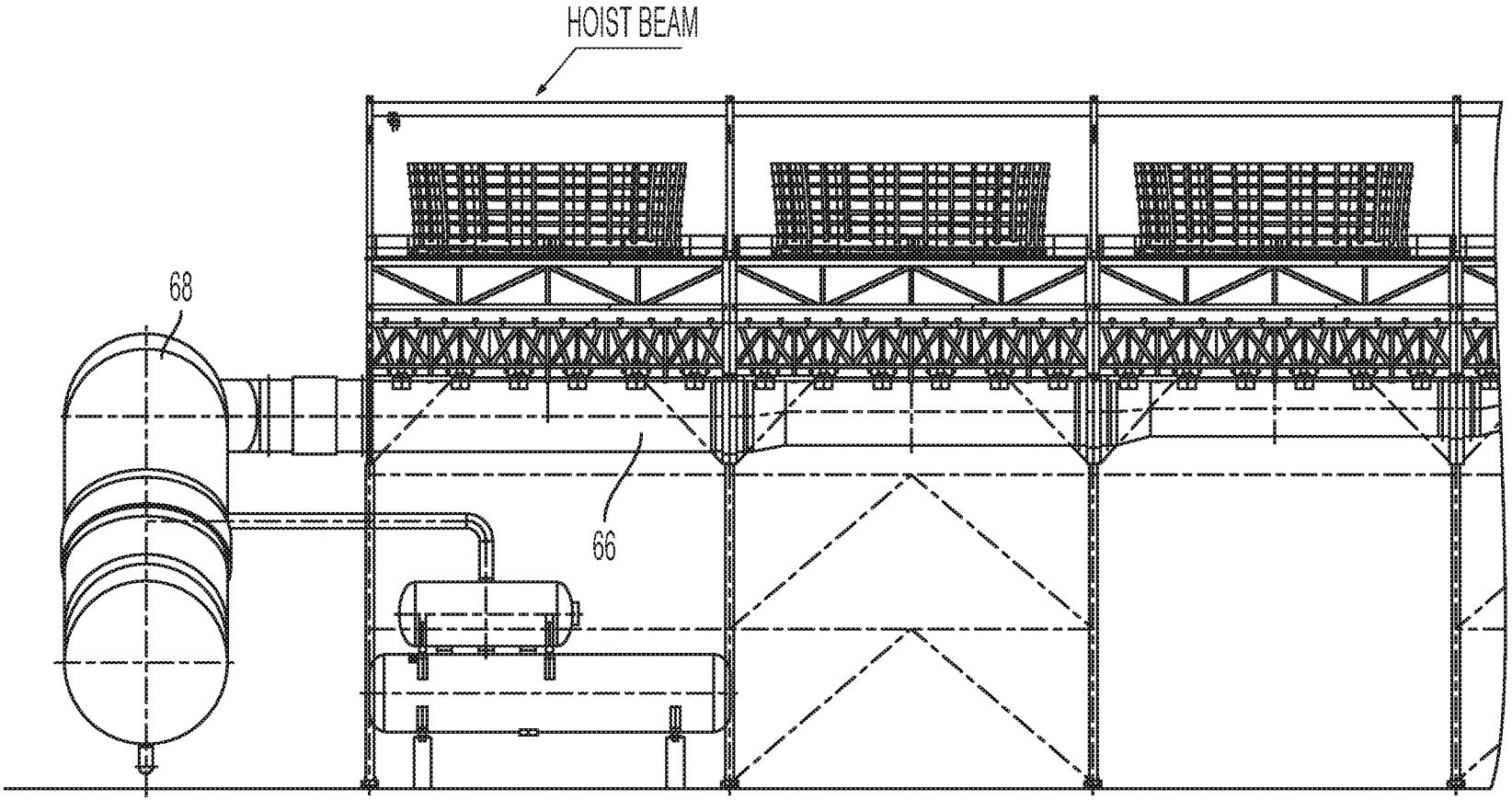
FIG. 26 is side view of a large scale field erected air cooled industrial steam condenser according to a second alternate embodiment of the invention having elevated steam distribution manifolds directly connected to the turbine steam duct.
Figure 27:
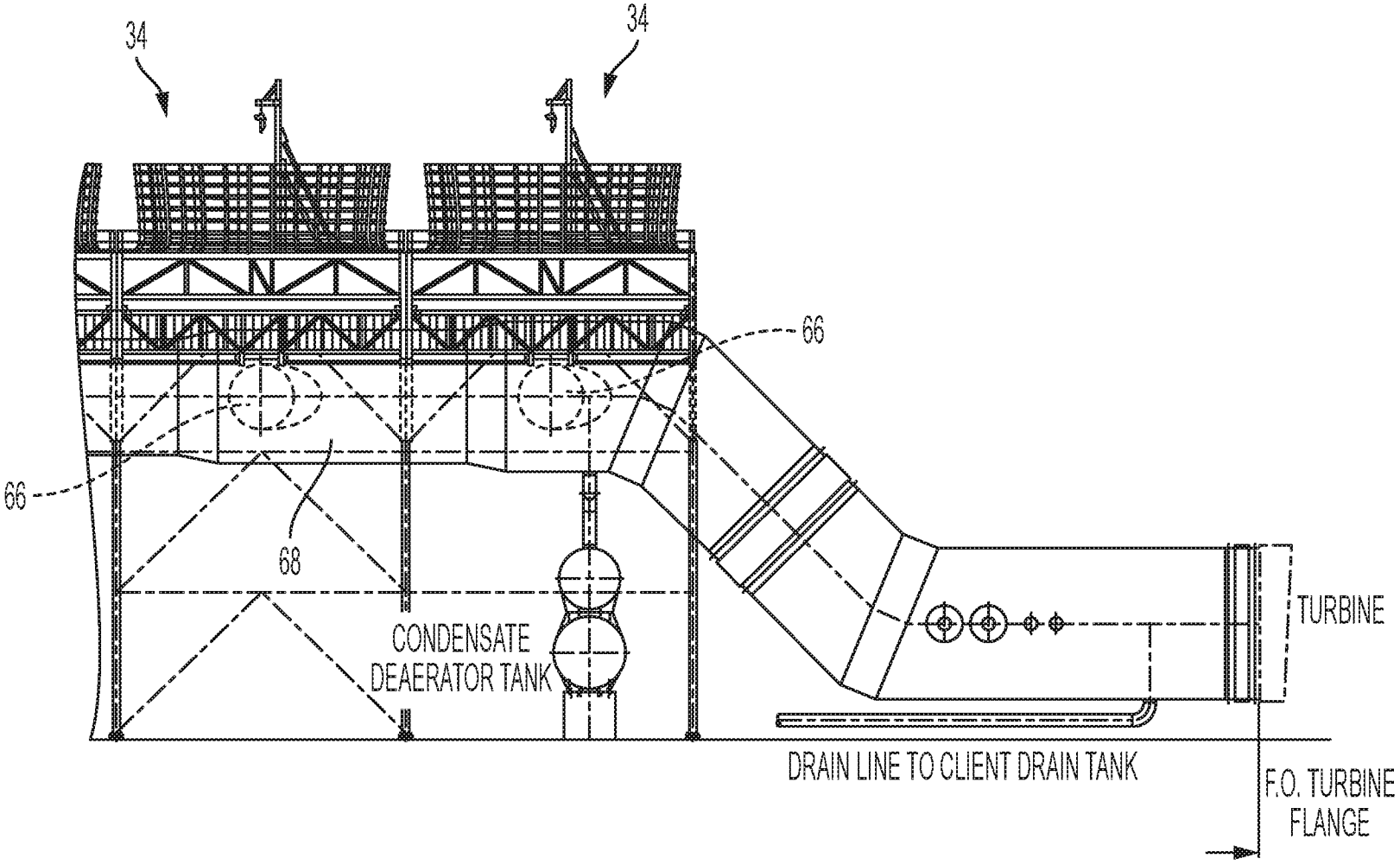
FIG. 27 is an end view of the embodiment shown in FIG. 26.

According to an alternate embodiment of the invention, shown in FIGS. 25-27, instead of the plurality of upper steam distribution manifolds 28, lower steam manifold 32 and risers 30, the air cooled condenser of the invention may instead have a plurality of elevated steam distribution manifolds 66 connected directly to an elevated turbine steam duct 68 in which each elevated steam distribution manifold runs the length and feeds the heat exchange panels of a plurality of heat exchange modules along a street/row 34 of condenser cells 27. The elevated steam distribution manifolds 66 may be suspended from the heat exchange module frame in the same way that the upper steam distribution manifolds 28 are suspended from the heat exchange module frame. Likewise, the elevated steam distribution manifolds 66 run perpendicular to the longitudinal axis of the heat exchange panels and is connected to the heat exchange panels at their center points through a plurality of Y-shaped nozzles to the pair of bonnet inlets/outlets of each adjacent pair of heat exchanger panels. According to this embodiment, the lower steam manifold 32 and riser 30 is eliminated, and the elevated steam manifold is fed directly from the turbine exhaust duct which itself is elevated to the level of the elevated steam manifold.

Figure 35:
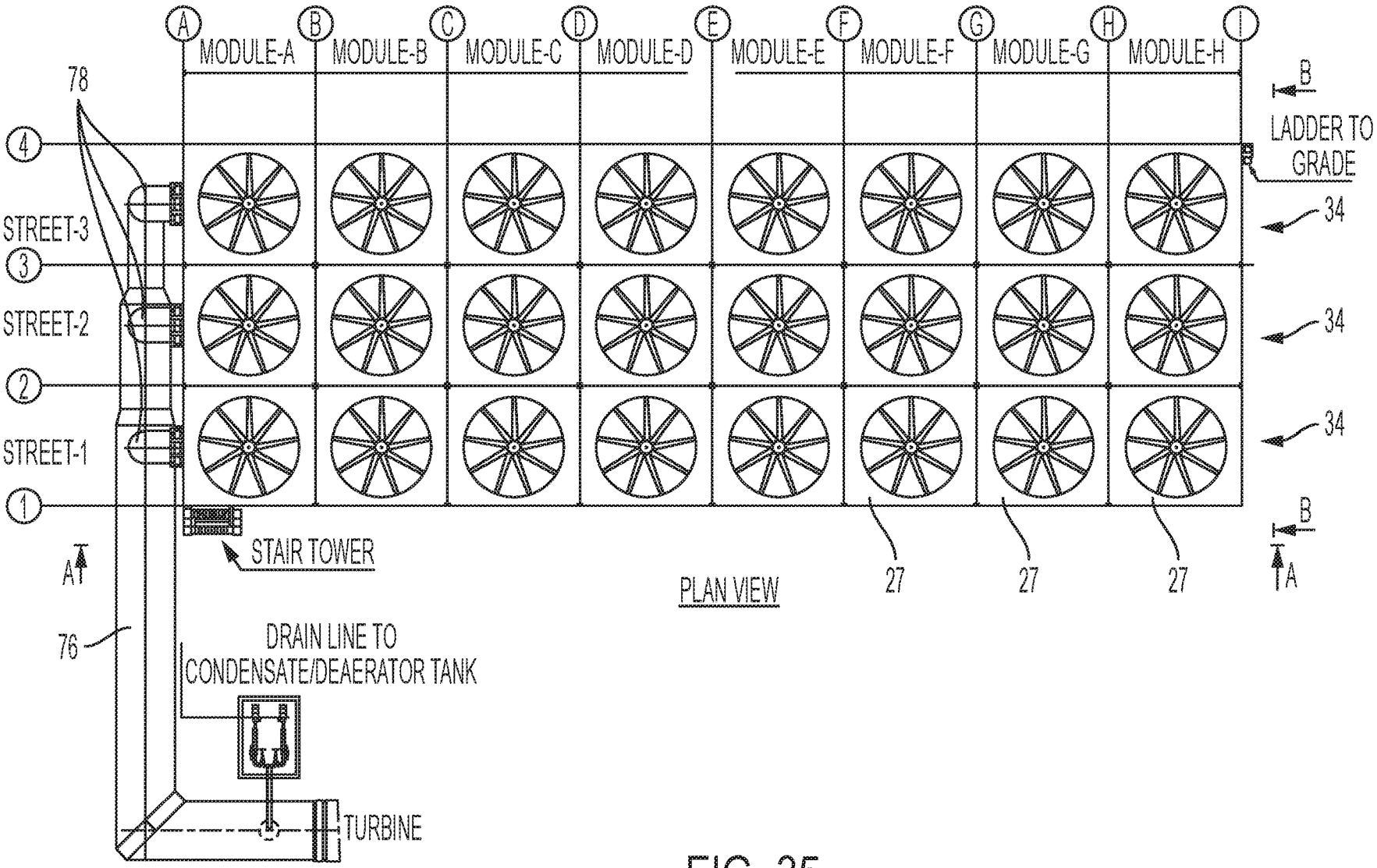
FIG. 35 is a plan view of a large scale field erected air cooled industrial steam condenser according to an alternate embodiment of the invention having an elevated steam distribution manifolds connected to a ground level turbine exhaust duct via end risers.
Figure 36:
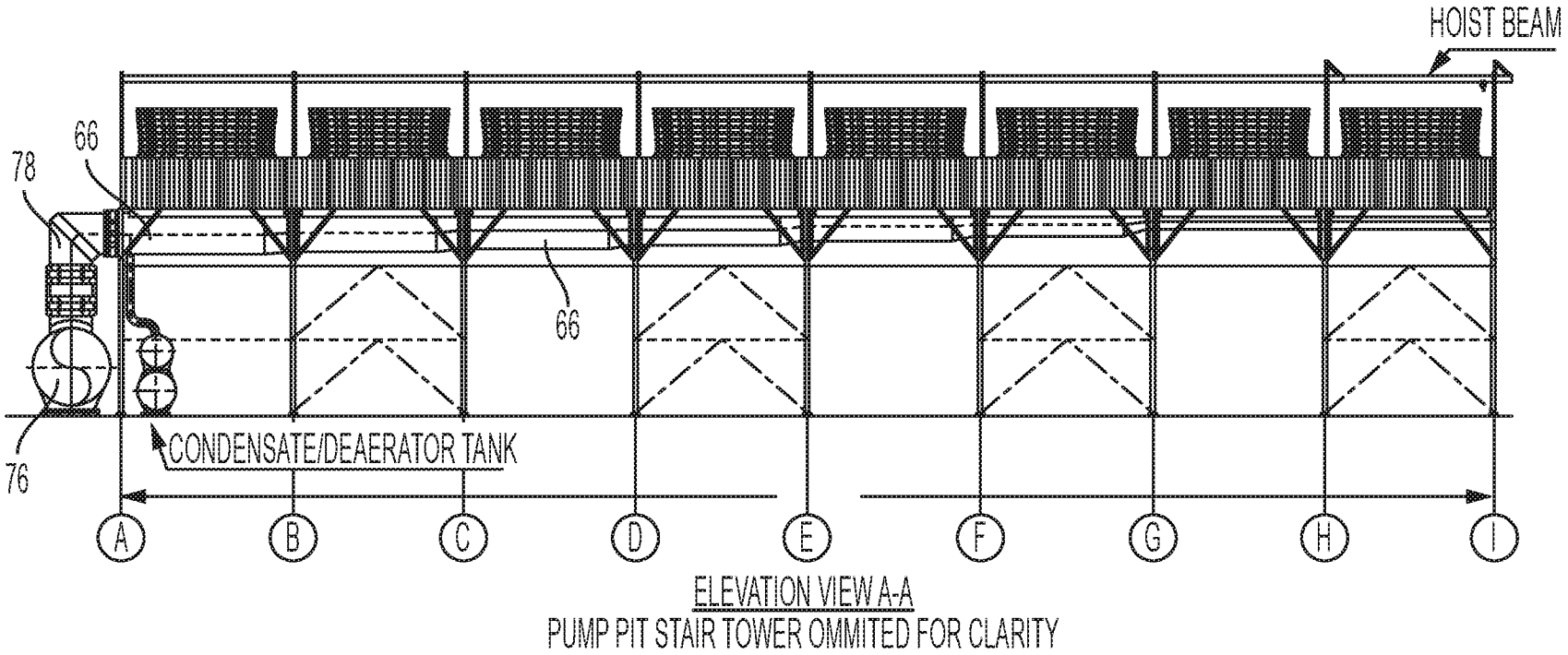
FIG. 36 is an elevation view of the embodiment of FIG. 35, along section A-A.
Figure 37:
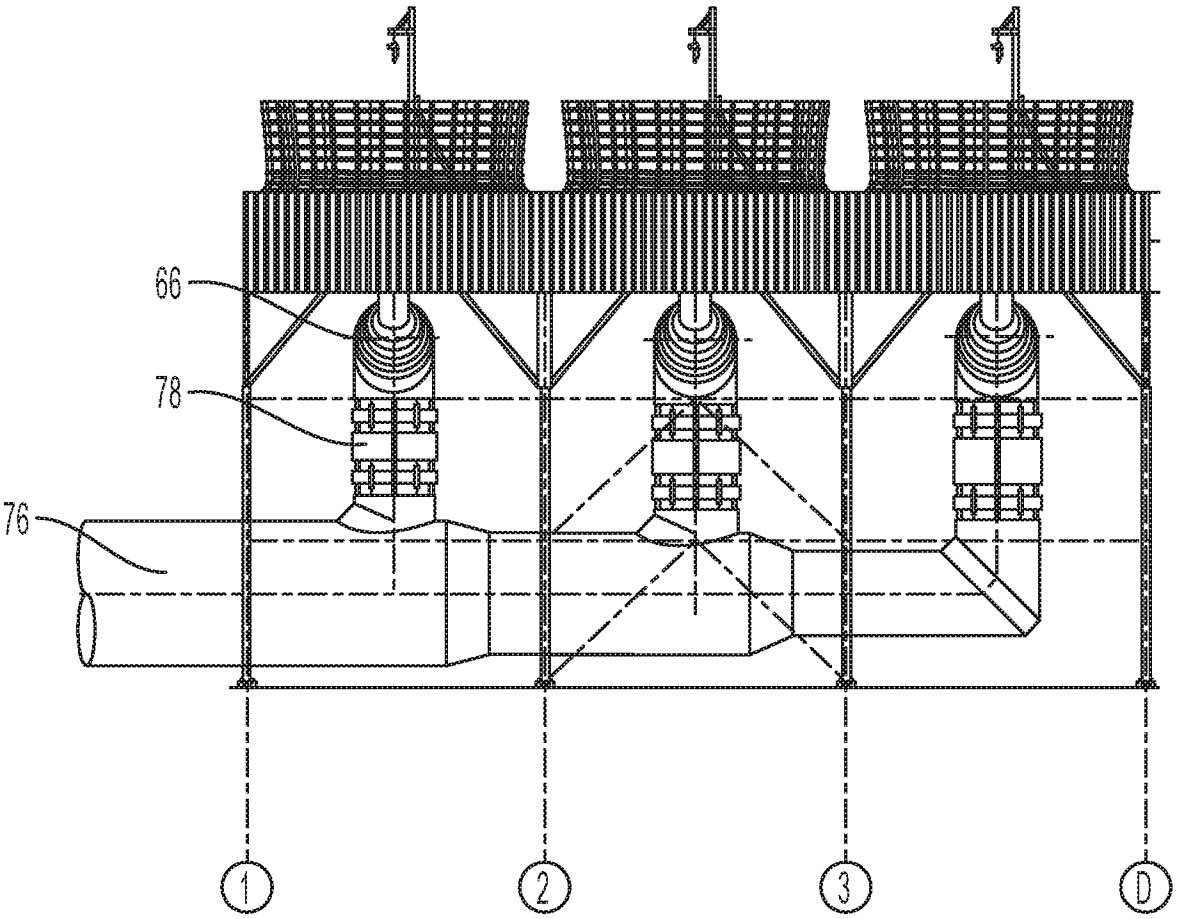
FIG. 37 is an elevation view of the embodiment of FIG. 35, along section B-B.

According to a further alternate embodiment of the invention, shown in FIGS. 35-37, the plurality of elevated steam distribution manifolds 66 may be connected to a ground level turbine exhaust duct 76 via end risers 78.

Figure 22:
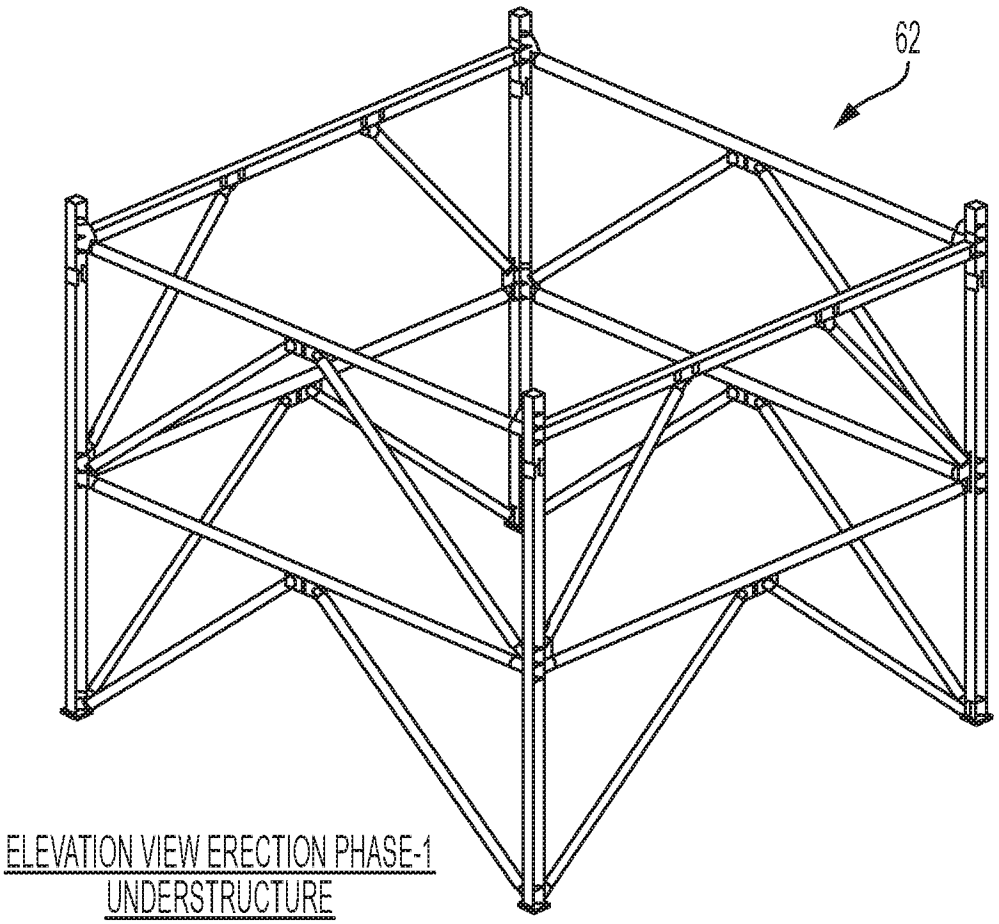
FIG. 22 shows a perspective view of a tower frame for a single cell corresponding to the condenser module shown in FIGS. 20A and 20B.
Figure 23:
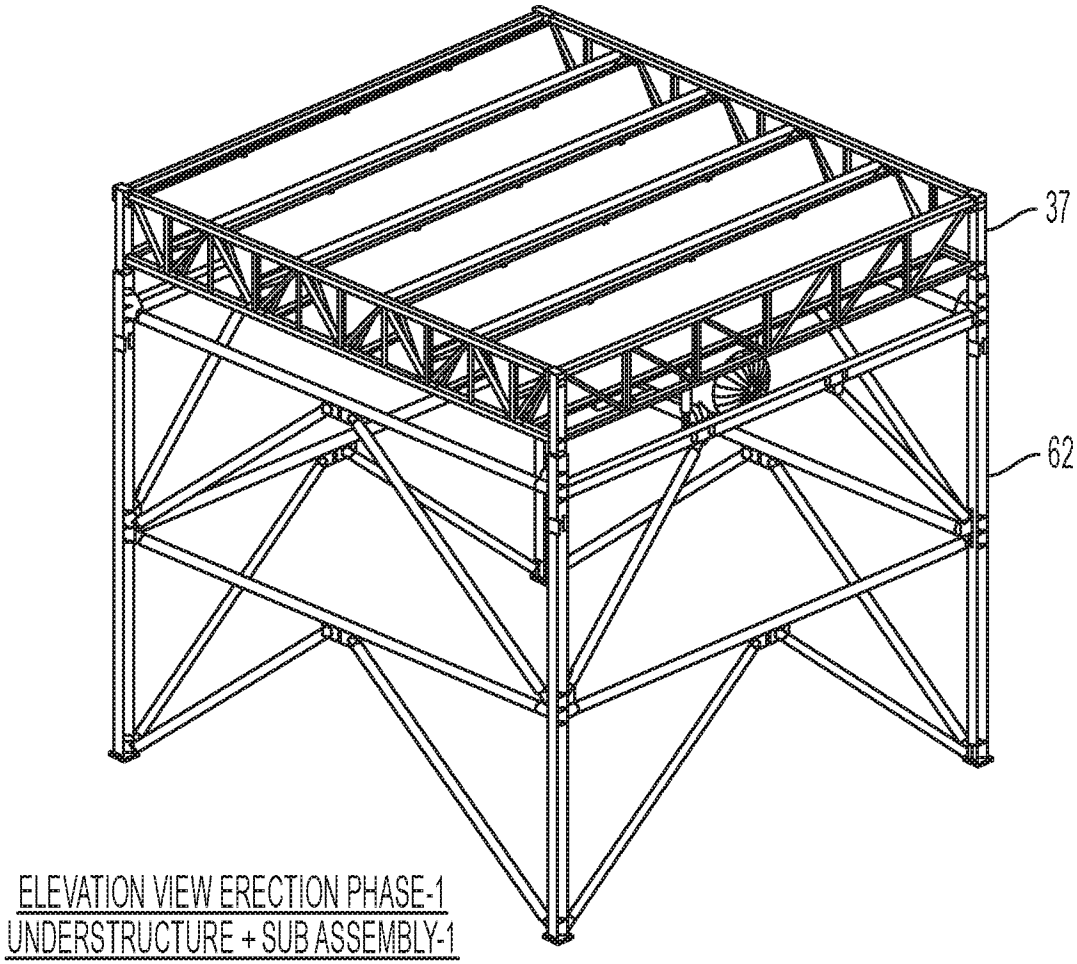
FIG. 23 shows the placement of the pre-assembled condenser module of FIGS. 20A and 20B lifted onto the tower frame of FIG. 22.

According to preferred embodiments of the invention, the ACCs of the invention are constructed in a modular fashion. According to various embodiments, understructure 62, condenser modules 37 and plenum sections 64 may be assembled separately and simultaneously on the ground. According to one embodiment, the heat exchange module frame may be lifted on a stick built understructure just high enough to suspend the upper steam distribution manifold 28 from the underside of the heat exchange module framework. The heat exchanger panels 2 are then lowered into and attached to the frame 36 of the condenser module 37 and to the upper steam distribution manifold 28, preferably at or just above ground level, see FIGS. 20A and 20B. Once completed, the assembled condenser module 37 with attached upper steam distribution manifold 28 may be lifted and placed on top of the corresponding completed understructure 62 (FIGS. 22 and 23).

Figure 30:
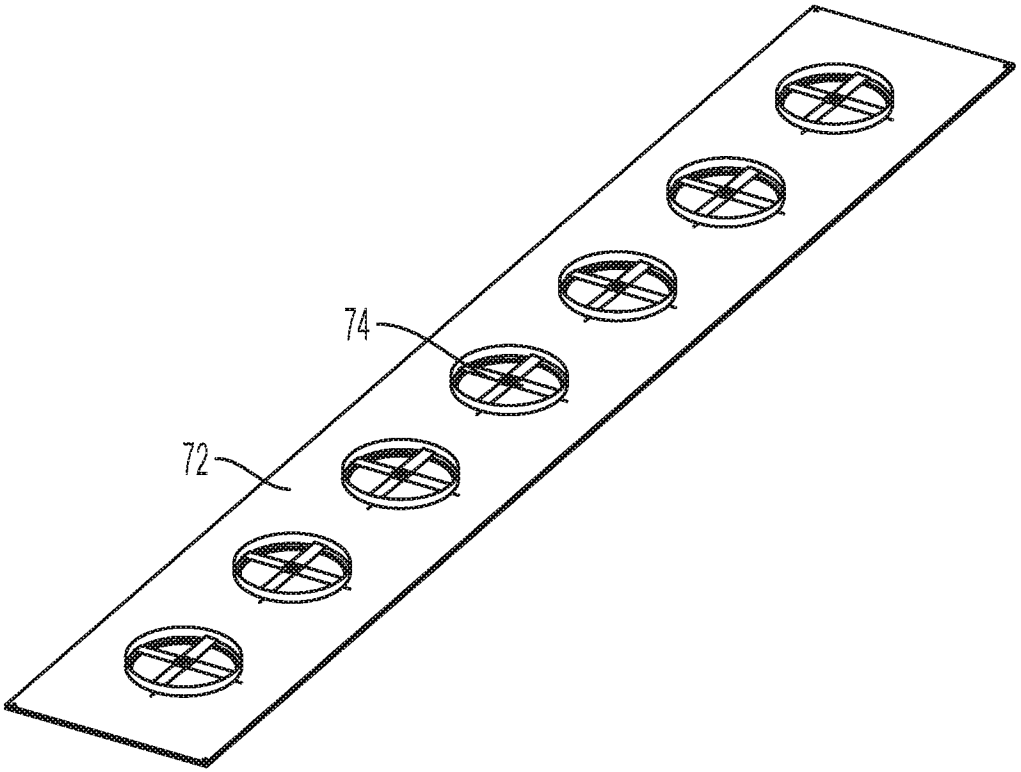
FIG. 30 is a representation of a fan deck plate according to an embodiment of the invention in which each plenum section module supports a plurality of fan deck plates, each fan deck plate supporting a plurality of fans.
Figure 31:
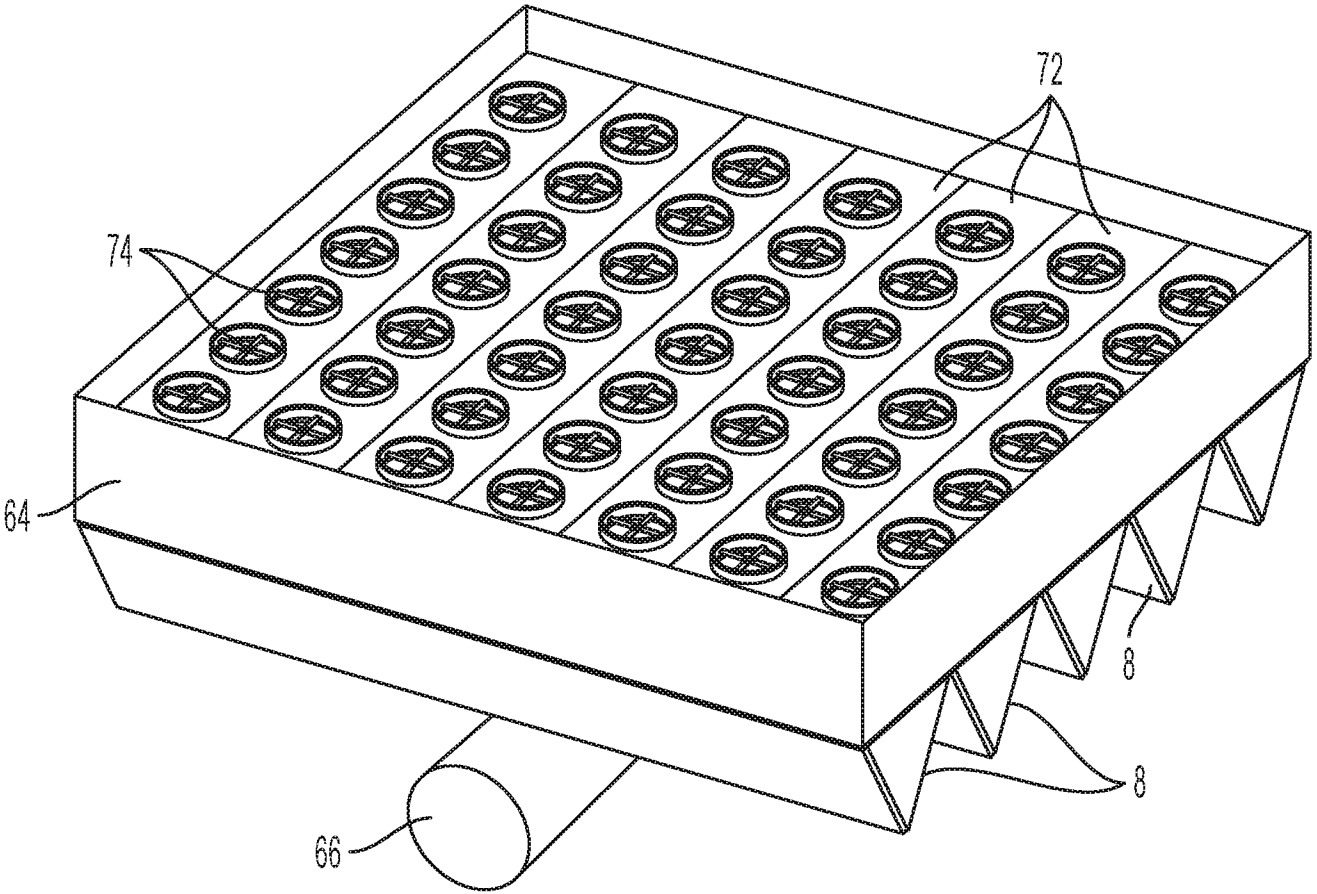
FIG. 31 is a representation of an embodiment of the invention in which the fan deck includes a plurality of fan deck plates supported on the fan deck structure above the heat exchange module, where each fan deck plate includes a plurality of fans, and the fan deck plates are arranged so that their longitudinal axis is perpendicular to the longitudinal axis of the heat exchange panels.
Figure 32:
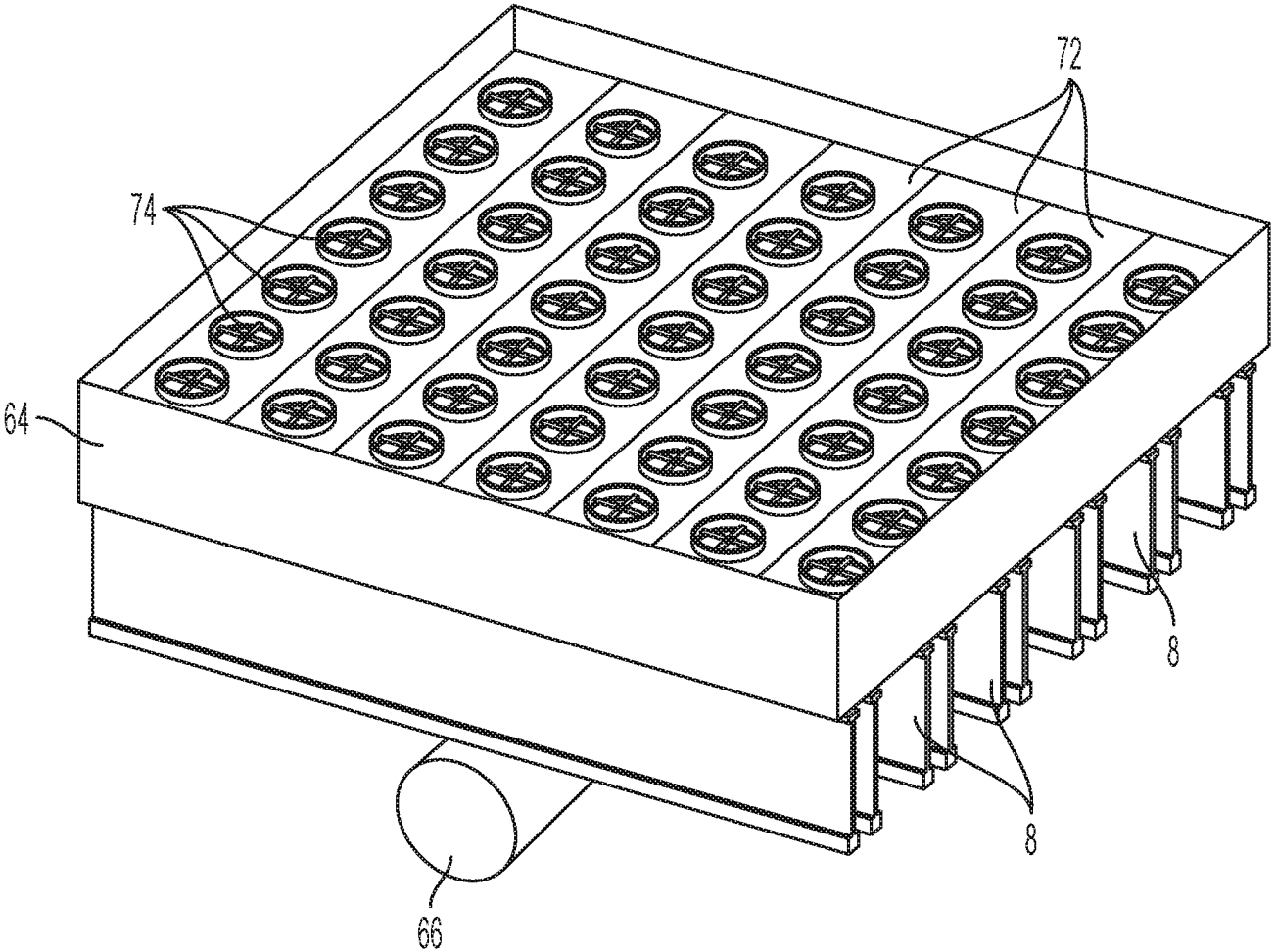
FIG. 32 is a representation of another embodiment of the invention in which the fan deck includes a plurality of fan deck plates supported on the fan deck structure above the heat exchange module, where each fan deck plate includes a plurality of fans, and the fan deck plates are arranged so that their longitudinal axis is perpendicular to the longitudinal axis of the heat exchange panels.
Figure 33:
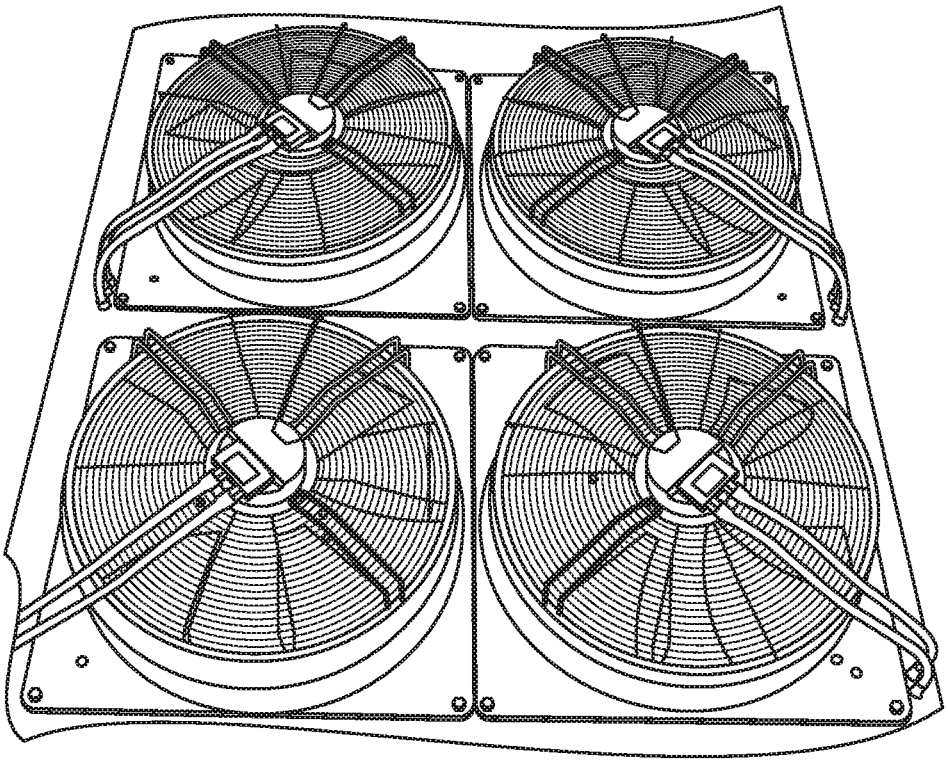
FIG. 33 shows examples of the type of fans that may be used in the fan deck plate embodiment of the invention.

The plenum section 64 for each ACC module 27, including the plenum section frame, fan deck supported on the plenum section frame, fan(s) and fan shroud(s), may be assembled at ground level with a single large fan, as shown, e.g., in FIGS. 13A, 13B, 14, 15, 21, 21B, and 24-29), or it may be assembled (also at ground level) with a plurality of elongated fan deck plates 72, each supporting a plurality of smaller fans 74 in a row, as shown in FIGS. 30-32. The fan deck plates 72 are each preferably sized to fit into a standard shipping container. Accordingly, the fans 74 may be attached to the fan deck plates 72 at the factory and shipped to the final assembly location. An example of fan 74 is shown in FIG. 33. According to various embodiments, the fan motors may be NEMA standard or electronically commutated. According to preferred aspects of the multiple fan deck plate embodiment, each fan draws air across no more than two heat exchange panels, fan replacement is significantly simplified, and the loss of one or even several fans does not make a significant difference in performance.

Figure 24:
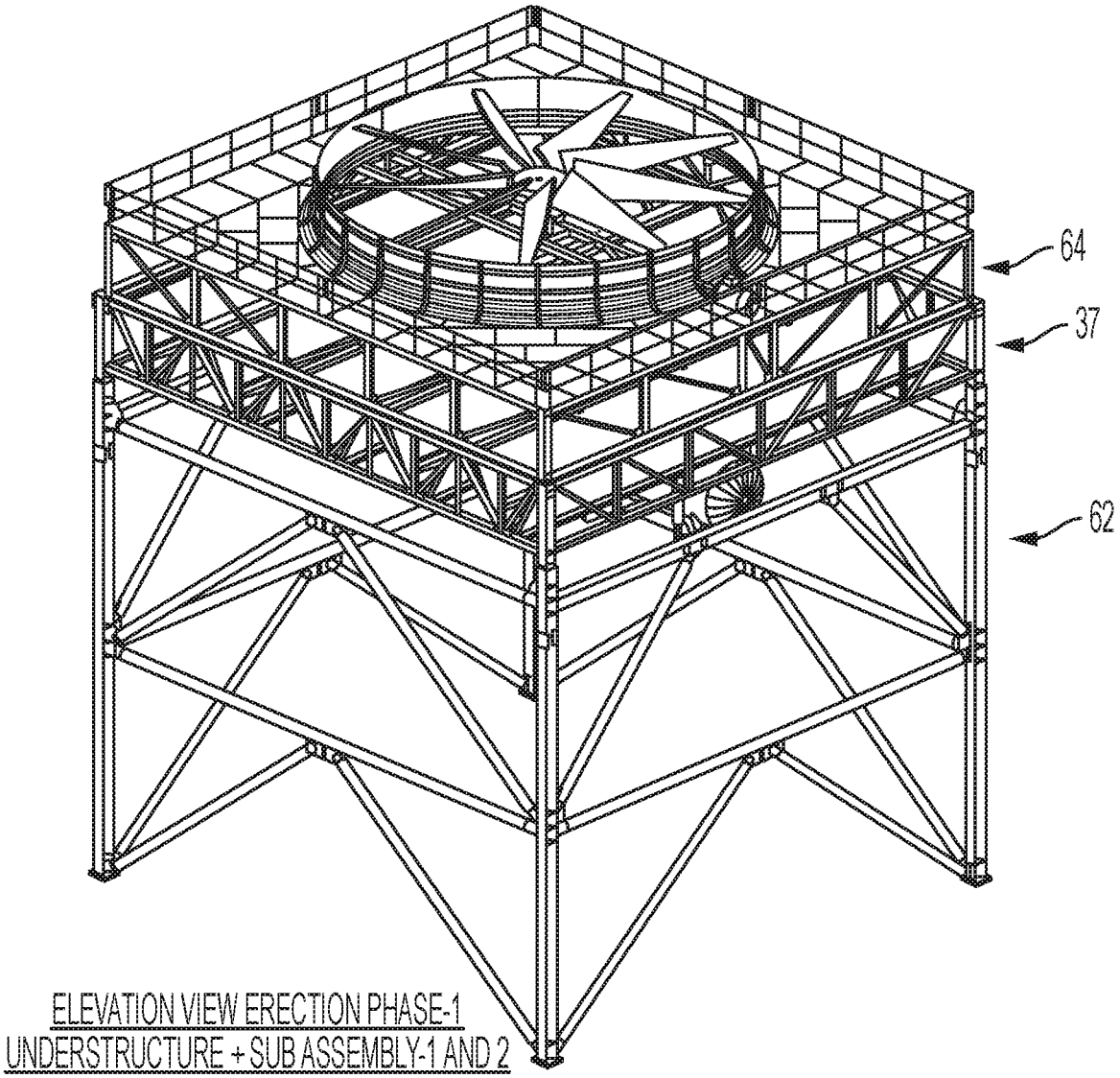
FIG. 24 shows the placement of the fan deck and fan (plenum) sub-assembly of FIGS. 21A and 21B installed atop the tower section and condenser modules in FIG. 23.

The completed corresponding plenum section 64 (FIGS. 21A and 21B or FIGS. 31 and 32) is subsequently lifted to rest on the top of the condenser module 37 (FIG. 24). Alternatively, plenum section framework (absent any fans or fan deck plates) may be lifted atop the condenser module 37, and the fan deck plates 72 may be lifted atop the framework of the plenum section 64 after the plenum section framework has been rested on top of the condenser module 37. While the assembly described herein is described as being performed at grade, the assembly of the various modules may be performed at their final position if planning and construction schemes allow.

Every feature and alternative embodiment herein is intended and contemplated to work with and be used in combination of every other feature and embodiment described herein with the exception of embodiments with which it is incompatible. That is, each heat exchange module arrangement described herein (e.g., single stage, multiple stage), and each heat exchange panel arrangement described herein, (e.g., all vertical, all tilted one way, each tilted in an alternate direction), and each tube type and each fin type described herein, each steam manifold arrangement described herein, and each fan arrangement (single fan, multiple fan), is intended to be used in various ACC assemblies with every combination of embodiments with which they are compatible, and the inventors do not consider their inventions to be limited to the exemplary combinations of embodiments that are reflected in the specification and figures for purpose of exposition.

The invention claimed is:

1. A large scale field erected air cooled industrial steam condenser connected to an industrial steam producing facility, comprising:

a condenser street comprising a row of condenser modules, each condenser module comprising a plenum section having a single fan or multiple fans drawing air through a plurality of heat exchanger panels supported in a heat exchanger section, and each heat exchanger panel having a longitudinal axis and a transverse axis perpendicular to its longitudinal axis;

each heat exchanger panel comprising a plurality of tubes, a top bonnet connected to and in fluid communication with a top end of each of said plurality of tubes, a bottom bonnet connected to and in fluid communication with a bottom end of at least a subset of said plurality of tubes, said bottom bonnet having a single steam inlet;

said condenser street further comprising a steam distribution manifold suspended from said heat exchanger section and arranged along an axis that is perpendicular to longitudinal axes of said heat exchanger panels at midpoints of said heat exchanger panels and extending a length of said condenser street beneath said plurality of heat exchanger panels, said steam distribution manifold comprising a cylinder having first and second ends, said cylinder closed at a second end distal from said first end, said cylinder having at its top surface a plurality of connections, each of said plurality of connections adapted to connect to a corresponding said single steam inlet.

2. The large scale field erected air cooled industrial steam condenser according to claim 1, wherein each heat exchanger panel comprises a single condenser stage in which all tubes in the heat exchanger panel receive steam from a bottom end of said tubes.

3. The large scale field erected air cooled industrial steam condenser according to claim 1, wherein each heat exchanger panel comprises a secondary condenser section, a primary condenser section, and a top bonnet connected to and in fluid communication with a top end of each tube in said secondary condenser section and said primary condenser section, said bottom bonnet connected to and in fluid communication with a bottom end of each tube in said primary condenser section, each heat exchange panel further comprising an internal secondary chamber inside the bottom bonnet connected to and in fluid communication with a bottom end of each tube in said secondary condenser section, said secondary bottom bonnet connected to a top side of said bottom bonnet.

4. The large scale field erected air cooled industrial steam condenser according to claim 3, wherein each heat exchanger panel comprises two primary condenser sections flanking said secondary section.

5. The large scale field erected air cooled industrial steam condenser according to claim 4, wherein the secondary condenser section is centrally located along said heat exchange panel and flanked at each end by one of said two primary condenser sections.

6. The large scale field erected air cooled industrial steam condenser according to claim 3, wherein said plurality of tubes in said heat exchanger panels have fins attached to flat sides of said tubes, said fins having a height of 18 mm to 20 mm spanning a space between adjacent tubes and contacting adjacent tubes, said fins spaced at 5 to 12 fins per inch.

7. The large scale field erected air cooled industrial steam condenser according to claim 1, wherein said steam distribution manifold cylinder is attached at said first end to a turbine exhaust duct.

8. The large scale field erected air cooled industrial steam condenser according to claim 1, wherein said steam distribution manifold cyliner is closed at both ends, and having at a bottom surface a single connection to a steam riser.

9. The large scale field erected air cooled industrial steam condenser according to claim 1, wherein each said heat exchanger panel is independently suspended from a frame of the heat exchanger section by a plurality of flexible hanging supports.

10. The large scale field erected air cooled industrial steam condenser according to claim 9, wherein said flexible hanging supports each comprise a central rod connected at each end to a connection sleeve, and wherein one connection sleeve of each flexible hanging support is connected to said heat exchanger section frame and a second connection sleeve of each flexible hanging support is connected to a tube sheet of said heat exchanger panel.

11. The large scale field erected air cooled industrial steam condenser according to claim 1, wherein all of the heat exchange panels in a single heat exchanger section are oriented in the same direction.

12. The large scale field erected air cooled industrial steam condenser according to claim 1, wherein all of the heat exchange panels in a single heat exchanger section are oriented vertically.

13. The large scale field erected air cooled industrial steam condenser according to claim 1, wherein all of the heat exchange panels in a single heat exchanger section are oriented in the same direction, at the same angle relative to vertical.

14. The large scale field erected air cooled industrial steam condenser according to claim 1, wherein all of the heat exchange panels on one side of a single heat exchanger section are inclined relative to vertical in one direction, and all of the heat exchange panels on the other side of the single heat exchanger section are inclined relative to vertical in an opposite direction.

15. The large scale field erected air cooled industrial steam condenser according to claim 1, said plenum section comprising a single fan resting on fan deck framework and drawing air over all of said heat exchange panels in said heat exchanger section.

16. The large scale field erected air cooled industrial steam condenser according to claim 1, said plenum section comprising a plurality of fan deck plates resting on fan deck framework, said fan deck plates each comprising a plurality of fans.

17. The large scale field erected air cooled industrial steam condenser according to claim 16, wherein in each fan draws air across no more than two heat exchange panels.

18. The large scale field erected air cooled industrial steam condenser according to claim 1, wherein said plurality of tubes in said heat exchanger panels have a length of 2.0 m to 2.8 m, a cross-sectional height of 120 mm and a cross-sectional width of 4-10 mm.

19. The large scale field erected air cooled industrial steam condenser according to claim 18, wherein said tubes have a cross-sectional width of 5.2-7 mm.

20. The large scale field erected air cooled industrial steam condenser according to claim 19, wherein said tubes have a cross-sectional width of 6.0 mm.

21. The large scale field erected air cooled industrial steam condenser according to claim 1, wherein said plurality of tubes in said heat exchanger panels have fins attached to flat sides of said tubes, said fins having a height of 9 to 10 mm, and spaced at 5 to 12 fins per inch.

22. A method of assembling a large scale field erected air cooled condenser according to claim 1, comprising:

assembling said heat exchange section at ground level, including a heat exchange section frame and said heat exchanger panels;

supporting said heat exchange section at a height from ground sufficient only to suspend a steam distribution manifold section directly beneath and adjacent said heat exchanger panels, assembling said plenum section with a fan deck and a fan assembly at ground level;

raising said assembled heat exchange section and said steam distribution manifold section and placing it atop a corresponding understructure;

attaching adjacent steam distribution manifold sections to one-another; and raising said assembled plenum section and placing it atop said heat exchange section.

23. A large scale field erected air cooled industrial steam condenser connected to an industrial steam producing facility, comprising:

a condenser street comprising a row of condenser modules, each condenser module comprising a plenum section having single fan or multiple fans drawing air through a plurality of heat exchanger panels supported in a heat exchange section, and each heat exchanger panel having a longitudinal axis and a transverse axis perpendicular to its longitudinal axis;

each heat exchanger panel comprising a plurality of condenser tubes, a top bonnet connected to and in fluid communication with a top end of each said plurality of condenser tubes, a bottom bonnet connected to and in fluid communication with a bottom end of each said plurality of condenser tubes, each said bottom bonnet having a single steam inlet;

each said condenser street having a single steam distribution manifold suspended from and directly adjacent to a bottom side of said heat exchanger section arranged along an axis that is perpendicular to longitudinal axes of said plurality of heat exchanger panels at midpoints of each of said plurality of heat exchanger panels and extending a length of said condenser street, said steam distribution manifold comprising a cylinder attached at a first end to a turbine exhaust duct, and closed at a second end distal from said first end, said cylinder having at its top surface a plurality of connections each adapted to connect to a respective said bottom bonnet single steam inlet.

* * * * *